US011842685B2

(12) United States Patent
Kim et al.

(10) Patent No.: US 11,842,685 B2
(45) Date of Patent: Dec. 12, 2023

(54) PIXEL AND DISPLAY DEVICE INCLUDING THE SAME

(71) Applicant: SAMSUNG DISPLAY CO., LTD., Yongin-si (KR)

(72) Inventors: Yong Jae Kim, Yongin-si (KR); In Jun Bae, Yongin-si (KR); Hyun Wook Choi, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/813,489

(22) Filed: Jul. 19, 2022

(65) Prior Publication Data

US 2023/0230543 A1 Jul. 20, 2023

(30) Foreign Application Priority Data

Jan. 14, 2022 (KR) ..... 10-2022-0006039

(51) Int. Cl.
*G09G 3/3233* (2016.01)
*G09G 3/3266* (2016.01)

(52) U.S. Cl.
CPC ..... *G09G 3/3233* (2013.01); *G09G 3/3266* (2013.01); *G09G 2300/0426* (2013.01); *G09G 2300/0819* (2013.01); *G09G 2300/0842* (2013.01); *G09G 2300/0861* (2013.01); *G09G 2310/08* (2013.01); *G09G 2320/02* (2013.01); *G09G 2320/0626* (2013.01); *G09G 2330/021* (2013.01)

(58) Field of Classification Search
None
See application file for complete search history.

(56) References Cited

U.S. PATENT DOCUMENTS

| | | | |
|---|---|---|---|
| 7,414,599 | B2 | 8/2008 | Chung et al. |
| 8,614,657 | B2 | 12/2013 | Han et al. |
| 9,093,008 | B2 | 7/2015 | Kato |
| 11,056,049 | B2 | 7/2021 | Kim et al. |

(Continued)

FOREIGN PATENT DOCUMENTS

| | | |
|---|---|---|
| CN | 112634832 | 4/2021 |
| KR | 10-0560780 | 3/2006 |

(Continued)

OTHER PUBLICATIONS

Notice of Allowance dated May 17, 2023, in corresponding U.S. Appl. No. 17/860,676.

*Primary Examiner* — Matthew Yeung
(74) *Attorney, Agent, or Firm* — F. Chau & Associates, LLC

(57) ABSTRACT

A pixel includes: a light emitting element; a first transistor generating a driving current flowing from a first power line to a second power line; a second transistor being turned on in response to a fourth scan signal; a third transistor being turned on in response to a second scan signal; a fourth transistor being turned on in response to a first scan signal; a fifth transistor being turned on in response to a third scan signal; a sixth transistor being turned off in response to a first emission control signal; a first capacitor; and a second capacitor. A period in which the second transistor is turned on and a period in which the third transistor is turned on do not overlap with each other.

20 Claims, 15 Drawing Sheets

(56) References Cited

U.S. PATENT DOCUMENTS

| | | | | |
|---|---|---|---|---|
| 2003/0227262 | A1 | 12/2003 | Kwon | |
| 2005/0287750 | A1 | 12/2005 | Lee | |
| 2006/0028408 | A1 | 2/2006 | Kim | |
| 2008/0048955 | A1 | 2/2008 | Yumoto et al. | |
| 2008/0170010 | A1 | 7/2008 | Kim | |
| 2008/0309653 | A1 | 12/2008 | Takahashi et al. | |
| 2009/0167743 | A1 | 7/2009 | Goh et al. | |
| 2010/0073344 | A1 | 3/2010 | Ohhashi | |
| 2011/0141095 | A1 | 6/2011 | Matsui et al. | |
| 2012/0019498 | A1 | 1/2012 | Jeong | |
| 2012/0119667 | A1 | 5/2012 | Kitazawa et al. | |
| 2013/0038588 | A1 | 2/2013 | Ono et al. | |
| 2013/0187554 | A1 | 7/2013 | Ono et al. | |
| 2014/0307012 | A1 | 10/2014 | Kishi | |
| 2015/0279277 | A1 | 10/2015 | Xu | |
| 2015/0371606 | A1* | 12/2015 | Lee | G09G 3/3233 345/82 |
| 2016/0055792 | A1* | 2/2016 | Lee | G09G 3/3233 315/173 |
| 2016/0063943 | A1 | 3/2016 | Lee et al. | |
| 2017/0084220 | A1 | 3/2017 | Im | |
| 2017/0186378 | A1 | 6/2017 | Na et al. | |
| 2019/0164491 | A1 | 5/2019 | Kim et al. | |
| 2019/0180687 | A1 | 6/2019 | Gai et al. | |
| 2021/0049965 | A1 | 2/2021 | Jeon et al. | |
| 2021/0074212 | A1 | 3/2021 | Kim et al. | |
| 2021/0125543 | A1 | 4/2021 | Kim et al. | |
| 2021/0142733 | A1 | 5/2021 | Kim et al. | |
| 2021/0327352 | A1 | 10/2021 | Zhang et al. | |
| 2021/0407419 | A1* | 12/2021 | Li | G09G 3/3258 |
| 2022/0230592 | A1 | 7/2022 | Zhao et al. | |
| 2022/0398978 | A1 | 12/2022 | Kim et al. | |

FOREIGN PATENT DOCUMENTS

| | | |
|---|---|---|
| KR | 1020190069208 | 6/2019 |
| KR | 1020210013509 | 2/2021 |
| KR | 1020210019635 | 2/2021 |
| KR | 1020210050050 | 5/2021 |
| KR | 1020210057277 | 5/2021 |

* cited by examiner

PIXEL AND DISPLAY DEVICE INCLUDING THE SAME

CROSS-REFERENCE TO RELATED APPLICATION

The present U.S. non-provisional patent application claims priority under 35 U.S.C. § 119(a) to Korean patent application No. 10-2022-0006039 filed on Jan. 14, 2022 in the Korean Intellectual Property Office, the entire disclosure of which is incorporated by reference herein.

1. TECHNICAL FIELD

The present disclosure generally relates to a pixel and a display device including the same.

2. DISCUSSION OF RELATED ART

A display device includes a plurality of pixels. Each of the pixels includes a plurality of transistors, and a light emitting element and a capacitor, which are electrically connected to the transistors. The transistors may generate a driving current, based on signals provided through signal lines, and the light emitting element may emit light, based on the driving current.

The display device may consume a large amount of power when driven at a high driving frequency. Power consumption of the display device may be reduced by lowering the driving frequency when a still image is displayed. However, the driving frequency cannot be reduced when the display device displays high-resolution or stereoscopic images.

SUMMARY

At least one embodiment of the disclosure provides a pixel in which a compensation period is sufficiently secured, and display quality deterioration according to a change in hysteresis characteristic of a driving transistor is prevented or removed.

At least one embodiment of the disclosure also provides a display device including the pixel.

In accordance with an embodiment of the present disclosure, there is provided a display device including: a pixel, a scan driver, an emission driver, and a data driver. The pixel is connected to first to fifth scan lines, a first emission control line, and a data line. The scan driver is configured to supply first to fifth scan signals respectively to the first to fifth scan lines. The emission driver is configured to supply a first emission control signal to the first emission control line. The data driver is configured to supply a data signal to the data line. The pixel includes: a light emitting element; a first transistor connected between a first node and a second node, the first transistor generating a driving current flowing from a first power line receiving a first power voltage to a second power line receiving a second power voltage through the light emitting element; a second transistor connected between the data line and the first node, the second transistor being turned on in response to the fourth scan signal; a third transistor connected between the second node and a third node connected to a gate electrode of the first transistor, the third transistor being turned on in response to the second scan signal; a fourth transistor connected between the third node and a third power line through which a third power voltage is provided, the fourth transistor being turned on in response to the first scan signal; a fifth transistor connected between the first node and a fourth node, the fifth transistor being turned on in response to the third scan signal; a sixth transistor connected between the first node and the first power line, the sixth transistor being turned off in response to the first emission control signal; a first capacitor connected between the first power line and the fourth node; and a second capacitor connected between the third node and the fourth node. The emission driver sets the scan signal so that a period in which the second transistor is turned on and a period in which the third transistor is turned on do not overlap with each other.

The pixel may further include: a seventh transistor connected between the second node and a first electrode of the light emitting element and an eighth transistor connected between a fifth node connected to the first electrode of the light emitting element and a fourth power line receiving fourth power voltage. The emission driver may apply a second emission control signal to a second emission control line to turn off the seventh transistor. The eighth transistor may be turned on in response to the fifth scan signal.

A first non-emission period of one frame may include a first compensation period in which the first emission control signal is supplied to the sixth transistor and the second scan signal is supplied to the third transistor and a data writing period in which the first emission control signal is not supplied to the sixth transistor and the fourth scan signal is supplied to the second transistor, so that the data voltage supplied to the data line is written to the fourth node.

The first non-emission period of the one frame may include a second compensation period in which the fourth scan signal is supplied to the second transistor, so that a bias voltage is transferred to the first transistor through the data line.

The fifth transistor may be turned on when the third scan signal is supplied in the first compensation period and the data writing period, and be turned off when the third scan signal is not supplied in the second compensation period.

In a second non-emission period of the one frame, the scan driver may supply the fourth signal plural times to the fourth scan line.

In the second non-emission period of the one frame, the fourth scan signal supplied a plurality of times may be supplied to the second transistor, so that the bias voltage is transferred to the first transistor through the data line.

Each of the third transistor, the fourth transistor, and the fifth transistor may be an oxide semiconductor transistor.

A pulse width of the first emission control signal may be equal to or greater than pulse widths of the fourth scan signal.

The fourth scan signal may be a signal shifted from the fifth scan signal.

In accordance with an embodiment of the present disclosure, there is provided a pixel including: a light emitting element; a first transistor connected between a first node and a second node; a second transistor connected between a data line and the first node; a third transistor connected between the second node and a third node connected to a gate electrode of the first transistor; a fourth transistor connected between the third node and a third power line receiving a third power voltage; a fifth transistor connected between the first node and a fourth node; a sixth transistor connected between the first node and the first power line receiving a first power voltage; a first capacitor connected between the first power line and the fourth node; and a second capacitor connected between the third node and the fourth node. The first transistor generates a driving current flowing from the first power line to a second power line receiving a second power voltage through the light emitting element. The second transistor is turned on in response to a fourth scan signal. The third transistor is turned on in response to a second scan signal. The fourth transistor is turned on in response to a first scan signal. The fifth transistor is turned on in response to a third scan signal. The sixth transistor is turned off in response to a first emission control signal. The scan signals are set so that a period in which the second transistor is turned on and a period in which the third transistor is turned on do not overlap with each other.

The pixel may further include: a seventh transistor connected between the second node and a first electrode of the light emitting element and an eighth transistor connected between a fifth node connected to the first electrode of the light emitting element and a fourth power line receiving a fourth power voltage. The seventh transistor is turned off in response to a second emission control signal supplied to a second emission control line. The eighth transistor is turned on in response to a fifth scan signal.

A first non-emission period of one frame may include a first compensation period in which the first emission control signal is supplied to the sixth transistor and the second scan signal is supplied to the third transistor and a data writing period in which the first emission control signal is not supplied to the sixth transistor and the fourth scan signal is supplied to the second transistor, so that the data voltage supplied to the data line is written to the fourth node.

The first non-emission period of the one frame may include a second compensation period in which the fourth scan signal is supplied to the second transistor, so that a bias voltage is transferred to the first transistor through the data line.

The fifth transistor may be turned on when the third scan signal is supplied in the first compensation period and the data writing period, and be turned off when the third scan signal is not supplied in the second compensation period.

In accordance with an embodiment of the present disclosure, there is provided a display device including: a pixel, a scan driver, an emission driver, and a data driver. The pixel is connected to first to fifth scan lines, a first emission control line, and a data line. The scan driver is configured to supply first to fifth scan signals respectively to the first to fifth scan lines. The emission driver is configured to supply a first emission control signal to the first emission control line. The data driver is configured to supply a data signal to the data line. The pixel includes: a light emitting element; a first transistor connected between a first node and a second node, the first transistor generating a driving current flowing from a first power line receiving a first power voltage to a second power line receiving a second power voltage through the light emitting element; a second transistor connected between the data line and a fourth node, the second transistor being turned on in response to the fourth scan signal; a third transistor connected between the second node and a third node connected to a gate electrode of the first transistor, the third transistor being turned on in response to the second scan signal; a fourth transistor connected between the third node and a third power line through which a third power voltage is provided, the fourth transistor being turned on in response to the first scan signal; a fifth transistor connected between the first node and the fourth node, the fifth transistor being turned on in response to the third scan signal; a sixth transistor connected between the first node and the first power line, the sixth transistor being turned off in response to the first emission control signal; a ninth transistor connected between the first node and a fifth power line through which a fifth power voltage is supplied, the ninth transistor being turned on in response to the fifth scan signal; a first capacitor connected between the first power line and the fourth node; and a second capacitor connected between the third node and the fourth node. The emission driver sets the scan signals so that a period in which the second transistor is turned on and a period in which the third transistor is turned on do not overlap with each other.

The pixel may further include: a seventh transistor connected between the second node and a first electrode of the light emitting element, the seventh transistor being turned off in response to the second emission control signal supplied to the second emission control line; and an eighth transistor connected between a fifth node connected to the first electrode of the light emitting element and a fourth power line through which a fourth power voltage is provided, the eighth transistor being turned on in response to the fifth scan signal.

The fourth scan signal may be a signal shifted from the fifth scan signal.

A first non-emission period of one frame may include a first compensation period in which the first emission control signal is supplied to the sixth transistor and the second scan signal is supplied to the third transistor and a data writing period in which the first emission control signal is not supplied to the sixth transistor and the fourth scan signal is supplied to the second transistor, so that the data voltage supplied to the data line is written to the fourth node.

The first non-emission period of the one frame may include a second compensation period in which the third scan signal is not supplied to the fifth transistor and the fifth scan signal is supplied to the ninth transistor, so that a bias voltage is transferred to the first transistor through the fifth power line.

DETAILED DESCRIPTION

Figure 1:
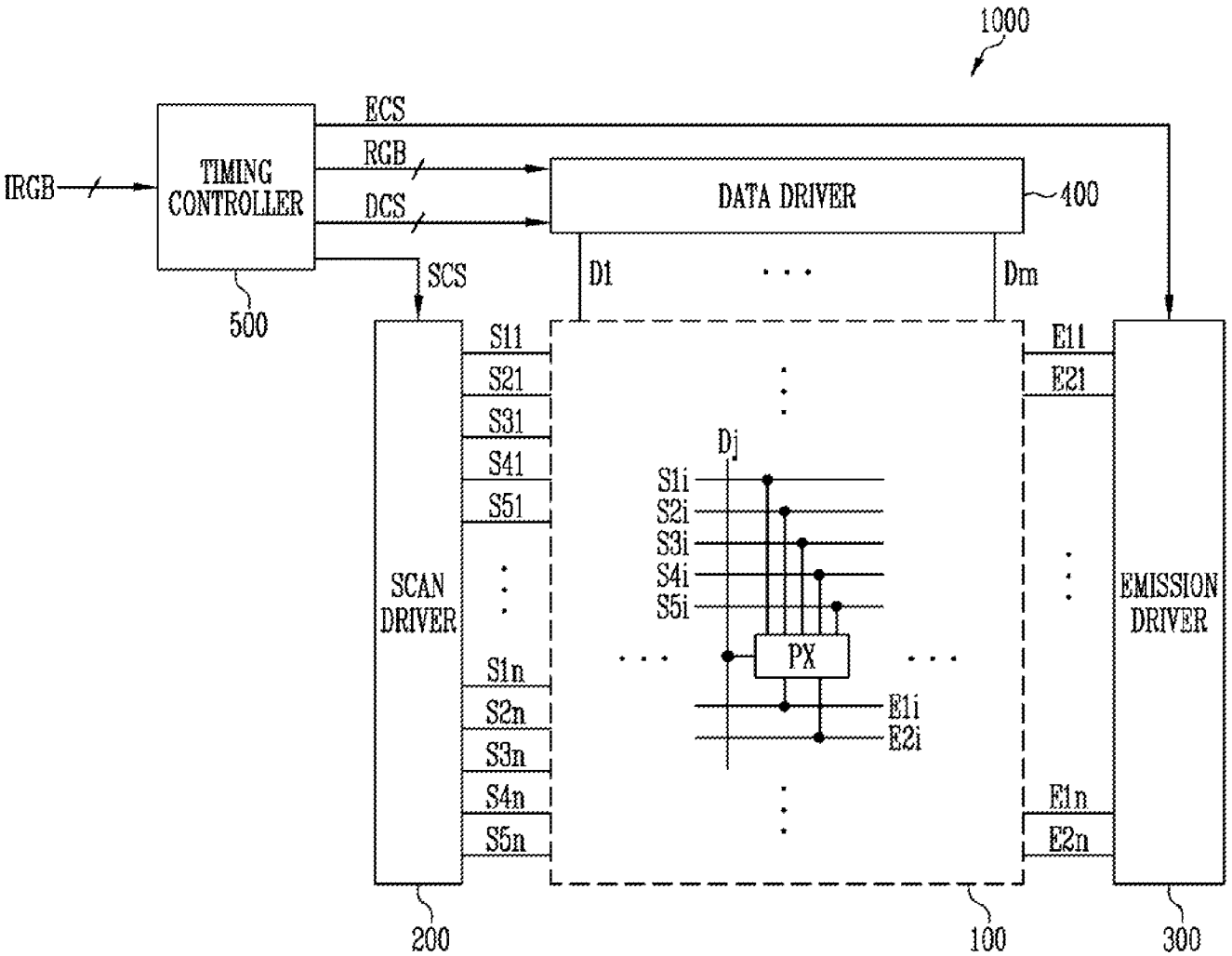
FIG. 1 is a block diagram illustrating a display device in accordance with an embodiment of the present disclosure.

Hereinafter, exemplary embodiments of the present disclosure will be described in more detail with reference to the accompanying drawings. Throughout the drawings, the same reference numerals are given to the same elements, and their overlapping descriptions will be omitted.

FIG. 1 is a block diagram illustrating a display device in accordance with an embodiment of the present disclosure.

Referring to FIG. 1, the display device 1000 in accordance with the embodiment of the present disclosure may include a pixel unit 100 (e.g., a display panel), a scan driver 200 (e.g., a driver circuit), an emission driver 300 (e.g., a driver circuit), a data driver 400 (e.g., driver circuit), and a timing controller 500 (e.g., a control circuit).

The display device 1000 may display an image at various frame frequencies (e.g., refresh rates, driving frequencies, or screen refresh rates) according to driving conditions. The frame frequency is a frequency at which a data voltage is substantially written to a driving transistor of a pixel PX included in the pixel unit 100 for one second. For example, the frame frequency may be referred to as a screen scan rate or a screen refresh frequency, and represents a frequency at which a screen is refreshed each second.

Figure 2:
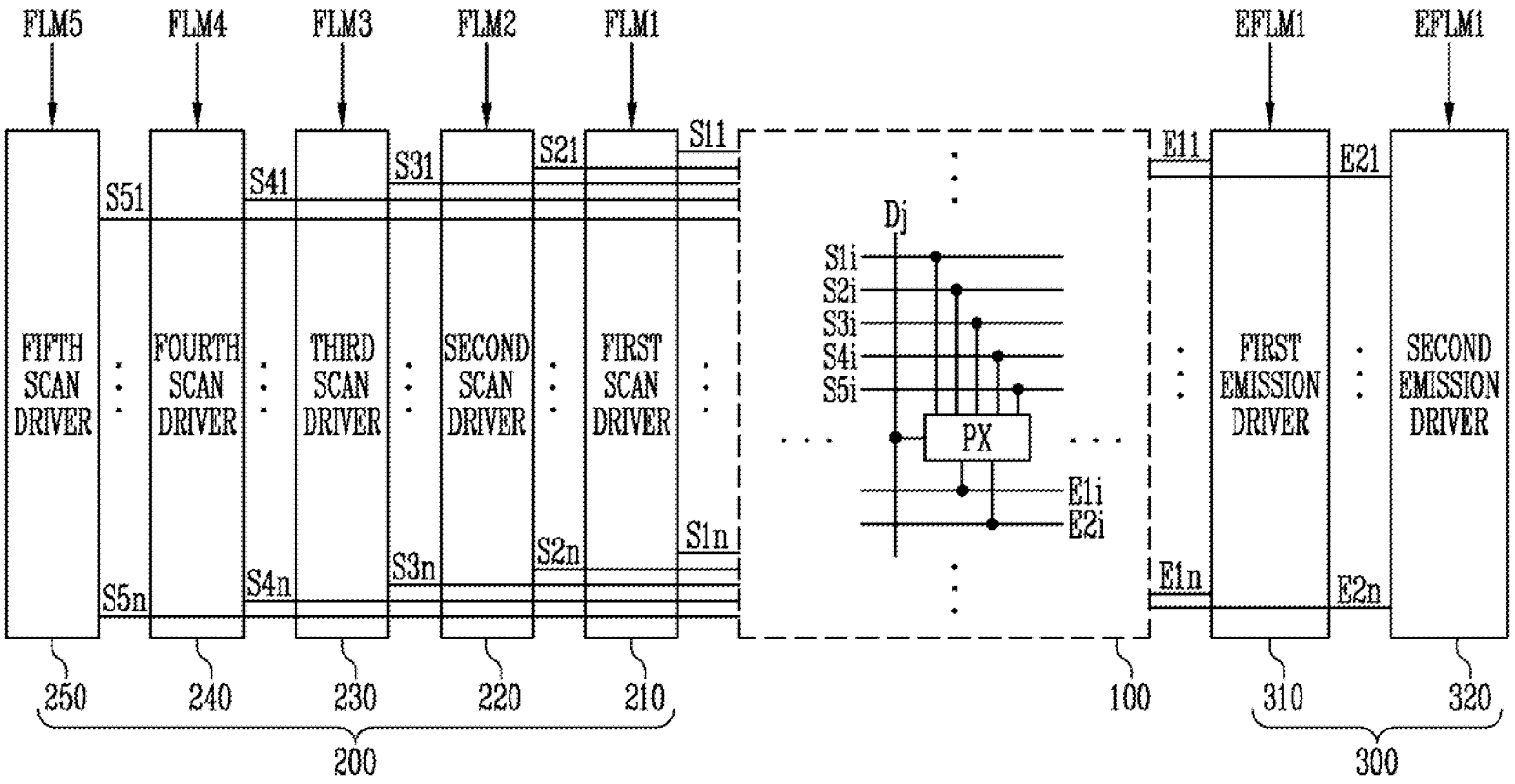
FIG. 2 is a diagram illustrating an example of a scan driver and an emission driver, which are included in the display device shown in FIG. 1.

In an embodiment, an output frequency of a data signal supplied from the data driver 400 and/or an output frequency of a scan signal (e.g., a fourth scan signal) supplied to a scan line (e.g., Si4 (fourth scan line) shown in FIG. 2) to supply the data signal may be changed corresponding to a frame frequency. For example, a frame frequency for driving of moving image data may be a frequency of about 60 Hz or higher (e.g., 60 Hz, 120 Hz, 240 Hz, 360 Hz, 480 Hz, or the like). In an example, when the frame frequency is 60 Hz, the fourth scan signal may be supplied 60 times per second to each horizontal line (pixel row) of the pixel unit 100.

In an embodiment, the display device 1000 may adjust output frequencies of the scan driver 200 and the emission driver 300 and an output frequency of the data driver 400, which corresponds to the output frequencies, according to driving conditions. For example, the display device 1000 may display an image, corresponding to various frame frequencies of 1 Hz to 240 Hz. However, this is merely illustrative, and the display device 1000 may also display an image at a frame frequency of 240 Hz or higher (e.g., 300 Hz or 480 Hz).

In an embodiment, the pixel unit 100 may include scan lines S11 to S1*n*, S21 to S2*n*, S31 to S3*n*, S41 to S4*n*, and S51 to S5*n*, emission control lines E11 to E1*n* and E21 to E2*n*, and data lines D1 to Dm, and include pixels PX connected to the scan lines S11 to S1*n*, S21 to S2*n*, S31 to S3*n*, S41 to S4*n*, and S51, the emission control lines E11 to E1*n* and E21 to E2*n*, and the data lines D1 to Dm (m and n are integers greater than 1). Each of the pixels PX may include a driving transistor and a plurality of switching transistors.

In an embodiment, the timing controller 500 may be supplied with input image data IRGB and control signals from a host system such as an Application Processor (AP) through a predetermined interface. The timing controller 500 may control driving timings of the scan driver 200, the emission driver 300, and the data driver 400.

In an embodiment, the timing controller 500 may generate a first control signal SCS, a second control signal ECS, and a third control signal DCS, based on the input image data IRGB, the control signals, and the like. The first control signal SCS may be supplied to the scan driver 200, the second control signal ECS may be supplied to the emission driver 300, and the third control signal DCS may be supplied to the data driver 400. The timing controller 500 may generate image data RGB by rearranging the input image data IRGB, and supply the image data RGB to the data driver 400.

In an embodiment, the scan driver 200 may receive the first control signal SCS from the timing controller 500, and supply a first scan signal, a second scan signal, a third scan signal, a fourth scan signal, and a fifth scan signal respectively to first scan lines S11 to S1*n*, second scan lines S21 to S2*n*, third scan lines S31 to S3*n*, fourth scan lines S41 to S4*n*, and fifth scan lines S51 to S5*n*, based on the first control signal SCS.

In an embodiment, the first to fifth scan signals may be set to a voltage having a gate-on level corresponding to a type of a transistor to which the corresponding scan signals are supplied. A transistor of a pixel receiving a scan signal may be set to a turn-on state when the scan signal is supplied. For example, the gate-on level of a scan signal supplied to a P-channel metal oxide semiconductor (PMOS) transistor may be a logic low level, and the gate-on level of a scan signal supplied to an N-channel metal oxide semiconductor (NMOS) transistor may be a logic high level. Hereinafter, it will be understood that the term "that a scan signal is supplied" means that the scan signal is supplied with a logic level at which a transistor controlled by the supply of the scan signal is turned on.

In an embodiment, the scan driver 200 may supply at least some of the first to fifth scan signals a plurality of times in a non-emission period. Accordingly, a bias state of a driving transistor included in the pixel PX can be controlled.

The emission driver 300 may supply a first emission control signal and a second emission control signal respectively to first emission control lines E11 to E1*n* and second emission control lines E21 to E2*n*, based on the second control signal ECS.

In an embodiment, the first and second emission signals may be set to a voltage (e.g., a high voltage) having a gate-off level. A transistor of a pixel receiving the first emission control signal or the second emission control signal may be turned off (e.g., set to a turned-off state) when the first emission control signal or the second emission control signal is supplied, and be turned on (e.g., set to a turn-on state) in other cases. Hereinafter, it will be understood that the term "that an emission control signal is supplied" means that the emission control signal is supplied with a logic level (e.g., a logic high level) at which a transistor controlled by the supply of the emission control signal is turned off.

For convenience of description, a case where each of the scan driver 200 and the emission driver 300 is a single component has been illustrated in FIG. 1, but the present disclosure is not limited thereto. The scan driver 200 may include a plurality of scan drivers each of which supplies at least one of the first to fifth signals according to a design. In addition, at least a portion of the scan driver 200 and the emission driver 300 may be integrated as one driving circuit, one module, or the like.

In an embodiment, the data driver 400 may receive the third control signal DCS and the image data RGB from the timing controller 500. The data driver 400 may convert the image data RGB in a digital form into an analog data signal (or data voltage). The data driver 400 may supply a data signal to the data lines D1 to Dm, corresponding to the third control signal DCS. The data signal supplied to the data lines D1 to Dm may be supplied to be synchronized with an output timing of the fourth scan signal supplied to the fourth scan lines S41 to S4*n*.

In an embodiment, the display device 1000 may further include a power supply. In an embodiment, the power supply may supply, to the pixel unit 100, a first power voltage (e.g., a first power voltage VDD shown in FIG. 4), a second power voltage (e.g., a second power voltage VSS shown in FIG. 4), a third power voltage (e.g., a third power voltage Vint1 shown in FIG. 4, or a first initialization voltage), and a fourth power voltage (e.g., a fourth power voltage Vint2 shown in FIG. 4, or a second initialization voltage). However, the present disclosure is not limited thereto. For example, the power supply may supply a fifth power voltage (e.g., a fifth power voltage Vbias shown in FIG. 9, or a bias voltage) to the pixel unit 100.

In an embodiment, the display device 1000 may operate at various frame frequencies. In the case of low frequency driving in which the display device 1000 is driven at a relatively low frame frequency (e.g., a frame frequency of 60 Hz or lower), an image defect such as a flicker may be perceived due to current leakage inside the pixel. In addition, an afterimage such as screen attraction may be perceived according to a change in bias state of the driving transistor due to driving at various frame frequencies, a change in response speed due to a threshold voltage shift caused by a hysteresis characteristic, or the like.

In an embodiment, one frame period includes a plurality of non-emission periods and a plurality of emission periods according to a frequency to increase image quality. For example, initial non-emission periods and emission periods of the one frame period may be defined as a first driving period. Subsequent non-emission periods and emission periods may be defined as a second driving period. For example, a data signal for image display may be substantially written in the pixel PX in the first driving period, and an on-bias voltage may be applied to the driving transistor of the pixel PX in the second driving period.

In an embodiment, in the case of high frequency driving in which the display device 1000 is driven at a relatively high frame frequency (e.g., a frame frequency of 120 Hz or higher), a threshold voltage compensation time of the driving transistor is sufficiently secured so as to implement image quality of a minimum reference. In the pixel PX and the display device 1000 in accordance with an embodiment of the present disclosure, a high-quality image can be displayed at various frame frequencies while securing a sufficient threshold voltage compensation time.

FIG. 2 is a diagram illustrating an example of the scan driver 200 and the emission driver 300, which are included in the display device 1000 shown in FIG. 1.

Referring to FIG. 2, the scan driver 200 may include a first scan driver 210, a second scan driver 220, a third scan driver 230, a fourth scan driver 240, and a fifth scan driver 250.

In an embodiment, each of the first to fifth scan drivers 210, 220, 230, 240, and 250 may include stage circuits dependently connected to each other.

In an embodiment, the first control signal SCS may include first to fifth scan start signals FLM1 to FLM5. The first to fifth scan start signals FLM1 to FLM5 may be respectively supplied to the first to fifth scan drivers 210, 220, 230, 240, and 250.

In an embodiment, widths (e.g., widths of pulses), supply timings, and the like of the first to fifth scan start signals FLM1 to FLM5 may be determined according to a driving condition of the pixel PX and a frame frequency.

In an embodiment, the first to fifth scan signals may be respectively output based on the first to fifth scan start signals FLM1 to FLM5. For example, a width of at least one signal (e.g., a pulse) among the first to fifth scan signals may be different from widths of the other signals. In an embodiment, at least one of the first to fifth scan signals is output a plurality of times during a non-emission period. Each of gate-on levels of the first to fifth scan signals may be determined according to a type of a corresponding transistor.

In an embodiment, the first scan driver 210 may sequentially supply the first scan signal to the first scan lines S11 to S1*n* in response to the first scan start signal FLM1. The second scan driver 220 may sequentially supply the second scan signal to the second scan lines S21 to S2*n* in response to the second scan start signal FLM2. The third scan driver 230 may sequentially supply the third scan signal to the third scan lines S31 to S3*n* in response to the third scan start signal FLM3. The fourth scan driver 240 may sequentially supply the fourth scan signal to the fourth scan lines S41 to S4*n* in response to the fourth scan start signal FLM4. The fifth scan driver 250 may sequentially supply the fifth scan signal to the fifth scan lines S51 to S5*n* in response to the fifth scan start signal FLM5.

In an embodiment, the emission driver 300 may include a first emission driver 310 and a second emission driver 320.

In an embodiment, the second control signal ECS may include first and second emission control start signals EFLM1 and EFLM2. The first and second emission control start signals EFLM1 and EFLM2 may be respectively supplied to the first and second emission drivers 310 and 320.

In an embodiment, each of the first and second emission drivers 310 and 320 may include stage circuits dependently connected to each other. In addition, a pulse width, a supply timing, and the like of the first emission control signal may be different from a pulse width, a supply timing, and the like of the second emission control signal.

In an embodiment, the first emission driver 310 may supply the first emission control signal to the first emission control lines E11 to E1*n* in response to the first emission control signal EFLM1. The second emission driver 320 may supply the second emission control signal to the second emission control lines E21 to E2*n* in response to the second emission control signal EFLM2.

Figure 3:
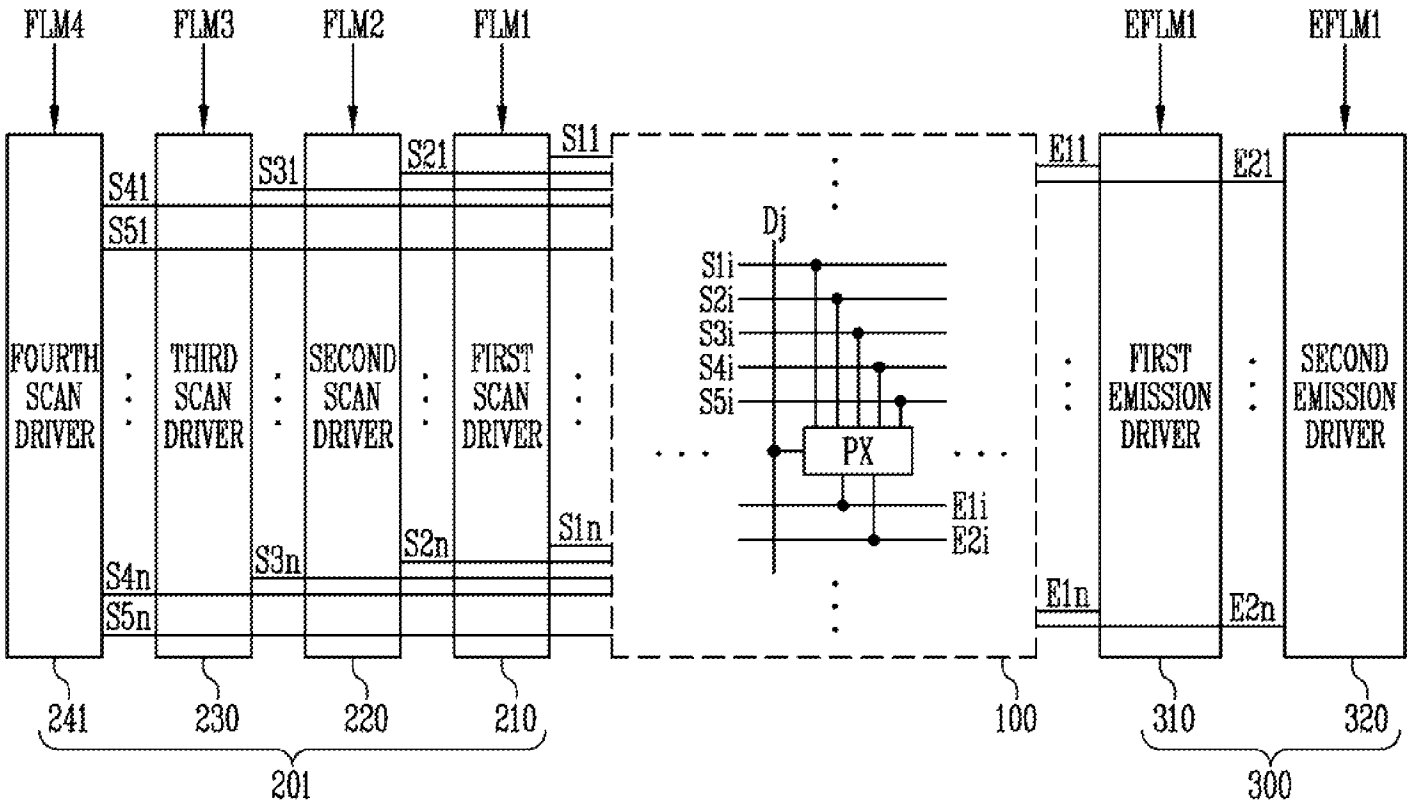
FIG. 3 is a diagram illustrating an example of a scan driver and the emission driver, which are included in the display device shown in FIG. 1.

FIG. 3 is a diagram illustrating an example of a scan driver 201 and the emission driver 300, which are included in the display device 1000 shown in FIG. 1. The scan driver 201 may be used to implement the scan driver 200 of FIG. 1.

In FIG. 3, contents are substantially identical or similar to those described with reference to FIG. 2, except the scan driver 201. Therefore, hereinafter, components identical or corresponding to those described with reference to FIG. 2 are designated by like reference numerals, and overlapping descriptions will be omitted.

Referring to FIG. 3, the scan driver 201 may include a first scan driver 210, a second driver 220, a third scan driver 230, and a fourth scan driver 241. The first scan driver 210, the second scan driver 220, and the third scan driver 230, which are included in the scan driver 201, are identical to the first scan driver 210, the second scan driver 220, and the third scan driver 230, which are included in the scan driver 210 shown in FIG. 2, and therefore, overlapping descriptions will be omitted.

In an embodiment, the fourth scan driver 241 may supply the fourth scan signal to the fourth scan lines S41 to S4*n* and supply the fifth scan signal to the fifth scan lines S51 to S5*n*, in response to a fourth scan start signal FLM4.

In an embodiment, a pulse width of the fourth scan signal is equal to a pulse width of the fifth scan signal. For example, the fourth scan signal supplied to the same pixel may be a signal shifted from the fifth scan signal. For example, a fifth scan line (e.g., S5*i*) connected to an ith (i is a natural number) pixel row may be connected to a fourth scan line (e.g., S4*i*) connected to an (i−1)th pixel row.

Accordingly, the size of the scan driver 201 included in the display device 1000 can be decreased, the line complexity of the display device 1000 can be reduced, and the manufacturing cost of the display device 1000 can be reduced.

However, this is merely illustrative, and the fourth scan signal and the fifth scan signal may be output from different scan drivers. For example, the fourth scan driver 241 may supply the fourth scan signal to the fourth scan lines S41 to S4*n*, and an additional scan driver may supply the third scan signal to the fifth scan lines S51 to S5*n*.

Figure 4:
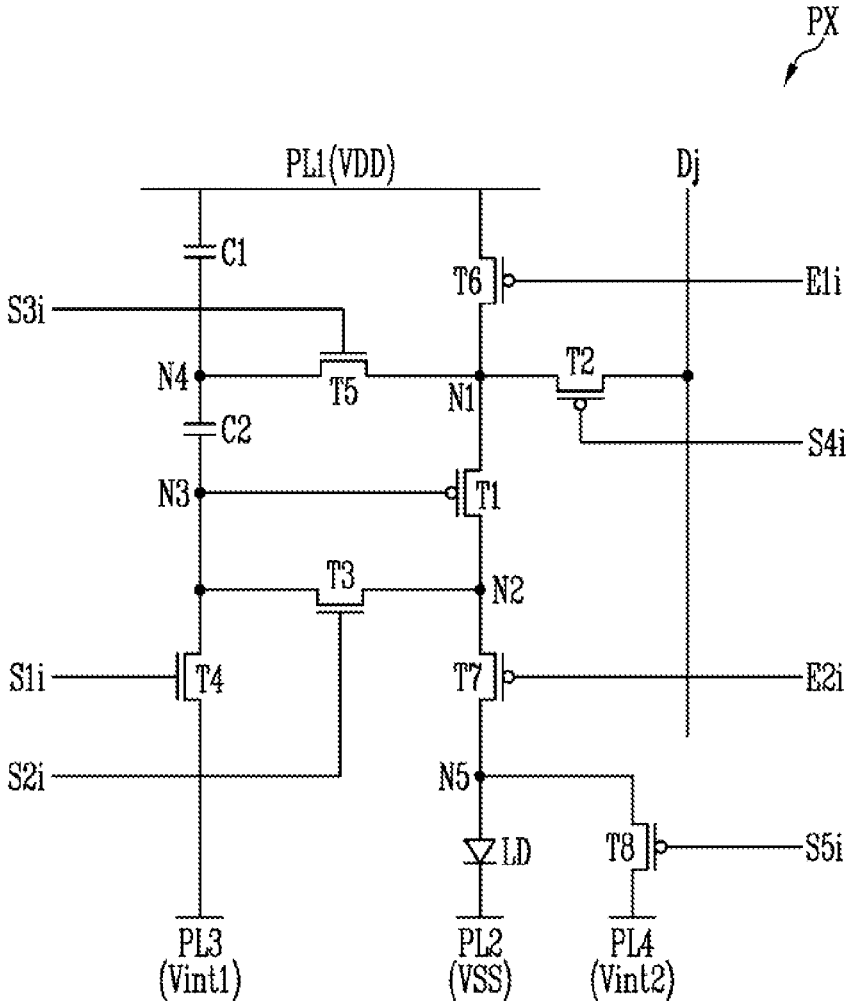
FIG. 4 is a circuit diagram illustrating an example of a pixel included in the display device in accordance with an embodiment of the present disclosure.

FIG. 4 is a circuit diagram illustrating an example of the pixel PX included in the display device 1000 in accordance with an embodiment of the present disclosure.

For convenience of description, a pixel PX which is located on an ith horizontal line (or ith pixel row) and is connected to a jth data line Dj is illustrated in FIG. 4 (i and j are natural numbers).

Referring to FIG. 4, the pixel PX may include a light emitting element LD, first to eighth transistors T1 to T8, a first capacitor C1 (or storage capacitor) and a second capacitor C2 (or compensation capacitor).

In an embodiment, a first electrode (e.g., an anode electrode) of the light emitting element LD may be connected to a fifth node N5, and a second electrode (e.g., a cathode electrode) of the light emitting element LD may be connected to a second power line PL2 through which the second power voltage VSS is transferred. The light emitting element LD may generate light with a predetermined luminance corresponding to an amount of current supplied from the first transistor T1.

In an embodiment, the second power line PL2 may have a line form, but the present disclosure is not limited thereto. For example, the second power line PL2 may be a conductive layer in a conductive plate form.

In an embodiment, the light emitting element LD may be an organic light emitting diode including an organic emitting layer. In another embodiment, the light emitting element LD may be an inorganic light emitting element formed of an inorganic material, such as a micro LED (light emitting diode) or a quantum dot light emitting diode. In another embodiment, the light emitting element LD may be a light emitting element configured with a combination of organic and inorganic materials.

Meanwhile, a case where the pixel PX includes a single light emitting element LD is illustrated in FIG. 4. However, in an embodiment, the pixel PX may include a plurality of light emitting elements, and the plurality of light emitting elements may be connected in series, parallel, or series/parallel to each other. For example, the light emitting element LD may have a form in which a plurality of light emitting elements (e.g., organic light emitting elements and/or inorganic light emitting elements) are connected in series, parallel, or series/parallel between the second power line PL2 and the fifth node N5.

In an embodiment, a first electrode (e.g., non-gate electrode) of the first transistor T1 (or driving transistor) is connected to a first node N1, and a second electrode (e.g., non-gate electrode) of the first transistor T1 is connected to a second node N2. A gate electrode of the first transistor T1 may be connected to a third node N3. The first transistor T1 may control a driving current flowing from a first power line PL1 through which the first power voltage VDD is provided to the second power line PL2 through which the second power voltage VSS is provided via the light emitting element LD, corresponding to a voltage of the third node N3. For example, the first power voltage VDD may be set to a voltage higher than the second power voltage VSS. In an embodiment, the second power voltage VSS is a ground voltage.

In an embodiment, the second transistor T2 may be connected between the jth data line Dj (hereinafter, referred to as a data line) and the first node N1. A gate electrode of the second transistor T2 may be connected to an ith fourth scan line S4*i* (hereinafter, referred to as a fourth scan line). The second transistor T2 may be turned on when the fourth scan signal is supplied to the fourth scan line S4*i*, to electrically connect the data line Dj and the first node N1 to each other. For example, the second transistor T2 may be turned on when the fourth scan signal has a low level.

In an embodiment, the third transistor T3 is connected to the second electrode of the first transistor T1 (i.e., the second node N2) and the third node N3. A gate electrode of the third transistor T3 may be connected to an ith second scan line S2*i* (hereinafter, referred to as a second scan line). The third transistor T3 may be turned on when the second scan signal is supplied to the second scan line S2*i*, to electrically connect the second electrode of the first transistor T1 and the third node N3 to each other. For example, the third transistor T3 may be turned on when the second scan signal has a high level. That is, a timing at which the second electrode (e.g., a drain electrode) of the first transistor T1 and the gate electrode of the first transistor T1 are connected to each other by the second scan signal may be controlled. When the third transistor T3 is turned on, the first transistor T1 may be connected in a diode form (e.g., diode connected). In an embodiment, the second transistor T2 is turned on during a first turn-on period, the third transistor T3 is turned on during a second turn-on period, and the first and second turn-on periods do not overlap one another.

In an embodiment, the fourth transistor T4 is connected between the third node N3 and a third power line PL3 through which the third power voltage Vint1 is provided. A gate electrode of the fourth transistor T4 may be connected to an ith first scan line S1*i* (hereinafter, referred to as a first scan line). The fourth transistor T4 may be turned on when the first scan signal is supplied to the first scan line S1*i*, to provide the third power voltage Vint1 to the third node N3. For example, the third power voltage Vint1 may be set as a voltage lower by a minimum level of a data signal supplied through the data line Dj.

In an embodiment, the fourth transistor T4 is turned on by the supply of the first scan signal, so that the third node N3 (or the gate electrode of the first transistor T1) is initialized to the third power voltage Vint1.

In an embodiment, the fifth transistor T5 is connected between the first node N1 and a fourth node N4. A gate electrode of the fifth transistor T5 may be connected to an ith third scan line S3*i* (hereinafter, referred to as a third scan line). The fifth transistor T5 may be turned on when the third scan signal is supplied to the third scan line, to supply the first power voltage VDD or a voltage of the data signal to the fourth node N4.

In an embodiment, the third transistor T3, the fourth transistor T4, and the fifth transistor T5 may be implemented with an oxide semiconductor transistor. The third transistor T3, the fourth transistor T4, and the fifth transistor T5 may include an oxide semiconductor layer as an active layer (e.g., a semiconductor or channel layer). For example, the third transistor T3, the fourth transistor T4, and the fifth transistor T5 may include an n-type oxide semiconductor transistor. However, the present disclosure is not limited thereto. For example, the third transistor T3, the fourth transistor T4, and the fifth transistor T5 may be implemented with a p-type semiconductor transistor.

The oxide semiconductor transistor can be formed through a low temperature process, and have a charge mobility lower than that of a poly-silicon semiconductor transistor. That is, the oxide semiconductor transistor has an excellent off-current characteristic. Thus, when the third transistor T3, the fourth transistor T4, and the fifth transistor T5 are implemented with the oxide semiconductor transistor, leakage current through the third transistor T3, the fourth transistor T4, and the fifth transistor T5 according to low frequency driving and variable frequency driving can be minimized, and accordingly, display quality can be increased.

In an embodiment, the sixth transistor T6 is connected between the first power line PL1 and the first node N1. A gate electrode of the sixth transistor T6 may be connected to an ith first emission control line Ei (hereinafter, a first emission control line). The sixth transistor T6 may be turned off when the first emission control signal is supplied to the first emission control line E1*i*, and be turned on in other cases. When the sixth transistor T6 is turned on, the first node N1 may be electrically connected to the first power line PL1.

In an embodiment, the seventh transistor T7 is connected between the second node N2 and the fifth node N5 (or the first electrode of the light emitting element LD). A gate electrode of the seventh transistor T7 may be connected to an ith second emission control line E1*i* (hereinafter, referred to as a second emission control line). The seventh transistor T7 may be turned off when the second emission control signal is supplied to the second emission control line, and be turned on in other cases. When the seventh transistor T7 is turned on, the second node N2 and the fifth node N5 may be electrically connected to each other.

In an embodiment, the eighth transistor T8 is connected between the fifth node N5 and a fourth power line PL4 through which the fourth power voltage Vint2 is provided. A gate electrode of the eighth transistor T8 may be connected to an ith fifth scan line S5*i* (hereinafter, referred to as a fifth scan line). The eighth transistor T8 may be turned on when the fifth scan signal is supplied to the fifth scan line S5*i*, to supply the fourth power voltage Vint2 to the fifth node N5.

In an embodiment, when the fourth power voltage Vint2 is supplied to the first electrode of the light emitting element LD (or the fifth node N5) by the supply of the fifth scan signal, a parasitic capacitor of the light emitting element LD may be discharged. Since a residual voltage charged in a parasitic capacitor is discharged (eliminated), unintended fine emission can be prevented. Thus, a black expression capability of the pixel PX can be increased. For example, the ability of the pixel PX to output light perceivable by a viewer as black rather than dark gray may be increased.

In an embodiment, the third power voltage Vint1 and the fourth power voltage Vint2 are different from each other. That is, a voltage at which the third node N3 (or the gate electrode of the first transistor T1) is initialized and a voltage at which the fifth node N5 (or the first electrode of the light emitting element LD) is initialized may be set different from each other.

In low frequency driving in which the length of one frame period is lengthened, when the third power voltage Vint1 supplied to the third node N3 (or the gate electrode of the first transistor T1) is excessively low, a strong on-bias voltage is applied to the first transistor T1, and hence a case where a threshold voltage of the first transistor T1 in the corresponding frame period is shifted may occur. Such a hysteresis characteristic of the first transistor T1 may cause a flicker phenomenon in the low frequency driving. Therefore, the third power voltage Vint1 higher than the second power voltage VSS may be used in the low frequency driving of the display device.

When the fourth power voltage Vint2 supplied to the fifth node N5 (or the first electrode of the light emitting element LD) becomes higher than a predetermined reference, a voltage of the parasitic capacitor of the light emitting element LD is not discharged but may be charged. Therefore, the fourth power voltage Vint2 may be set lower than the second power voltage VSS to reduce the voltage of the parasitic capacitor.

However, this is merely illustrative, and the third power voltage Vint1 and the fourth power voltage Vint2 may be variously set. In an example, the third power voltage Vint1 and the fourth power voltage Vint2 may be the same or substantially the same.

In an embodiment, the first capacitor C1 is connected between the first power line PL1 and the fourth node N4. The first power voltage VDD as a constant voltage may be continuously supplied to one electrode of the first capacitor C1. Therefore, a voltage of the fourth node N4 is not influenced by a parasitic capacitor, but may maintain voltage levels directly supplied to the fourth node N4. That is, the first capacitor C1 may serve as a hold capacitor.

In an embodiment, the second capacitor C2 is connected between the third node N3 and the fourth node N4. The second capacitor C2 may store a voltage difference between the third node N3 and the fourth node N4.

In an embodiment, some transistors of the pixel PX may be implemented with a poly-silicon semiconductor transistor. For example, the first, second, sixth, seventh, and eighth transistors T1, T2, T6, T7, and T8 may include a poly-silicon semiconductor layer formed through low temperature poly-silicon (LTPS) as an active layer (semiconductor layer or channel layer). Since the poly-silicon semiconductor transistor has a high response speed, the poly-silicon semiconductor transistor may be applied to a switching element that supports fast switching.

However, this is merely illustrative, and the types and kinds of the transistors are not limited to the above-described example.

Figure 5A:
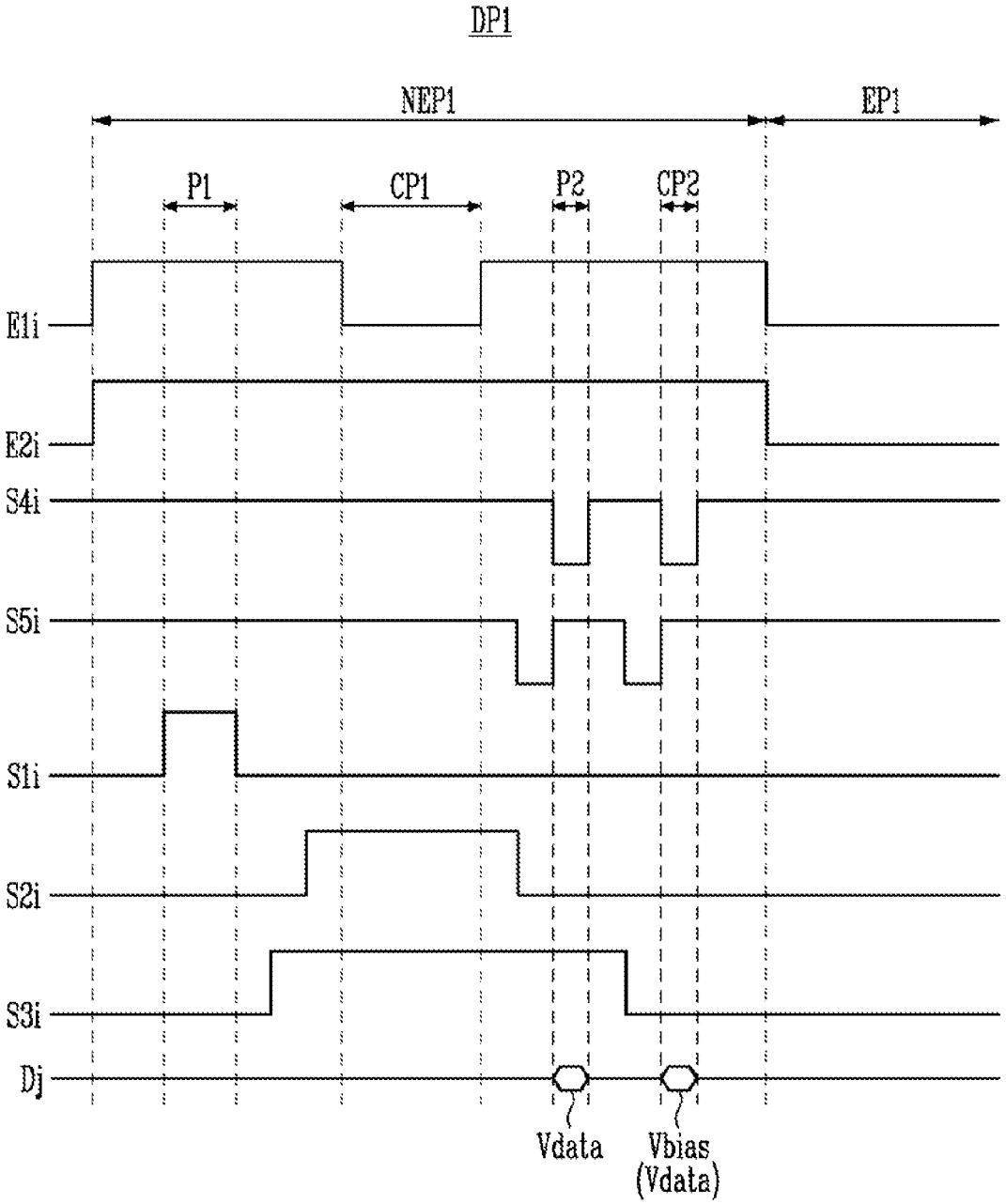
FIG. 5A is a timing diagram illustrating signals supplied to the pixel of the display device in a first driving period in accordance with an embodiment of the present disclosure.
Figure 5B:
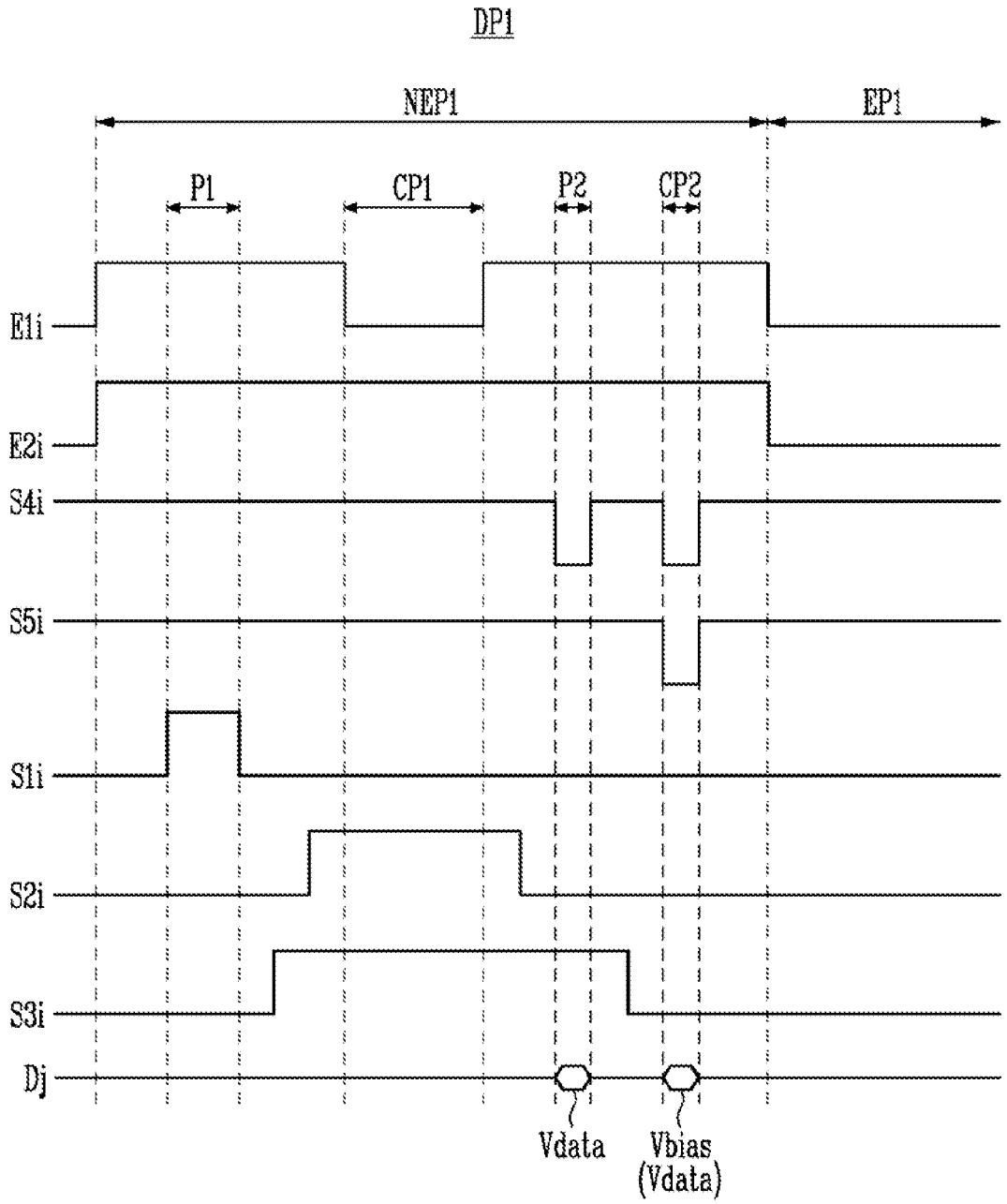
FIG. 5B is a timing diagram illustrating signals supplied to the pixel of the display device in the first driving period in accordance with an embodiment of the present disclosure.

FIG. 5A is a timing diagram illustrating signals supplied to the pixel PX of the display device 1000 in a first driving period DP1 in accordance with an embodiment of the present disclosure. FIG. 5B is a timing diagram illustrating signals supplied to the pixel PX of the display device 1000 in the first driving period DP1 in accordance with an embodiment of the present disclosure.

Figure 6A:
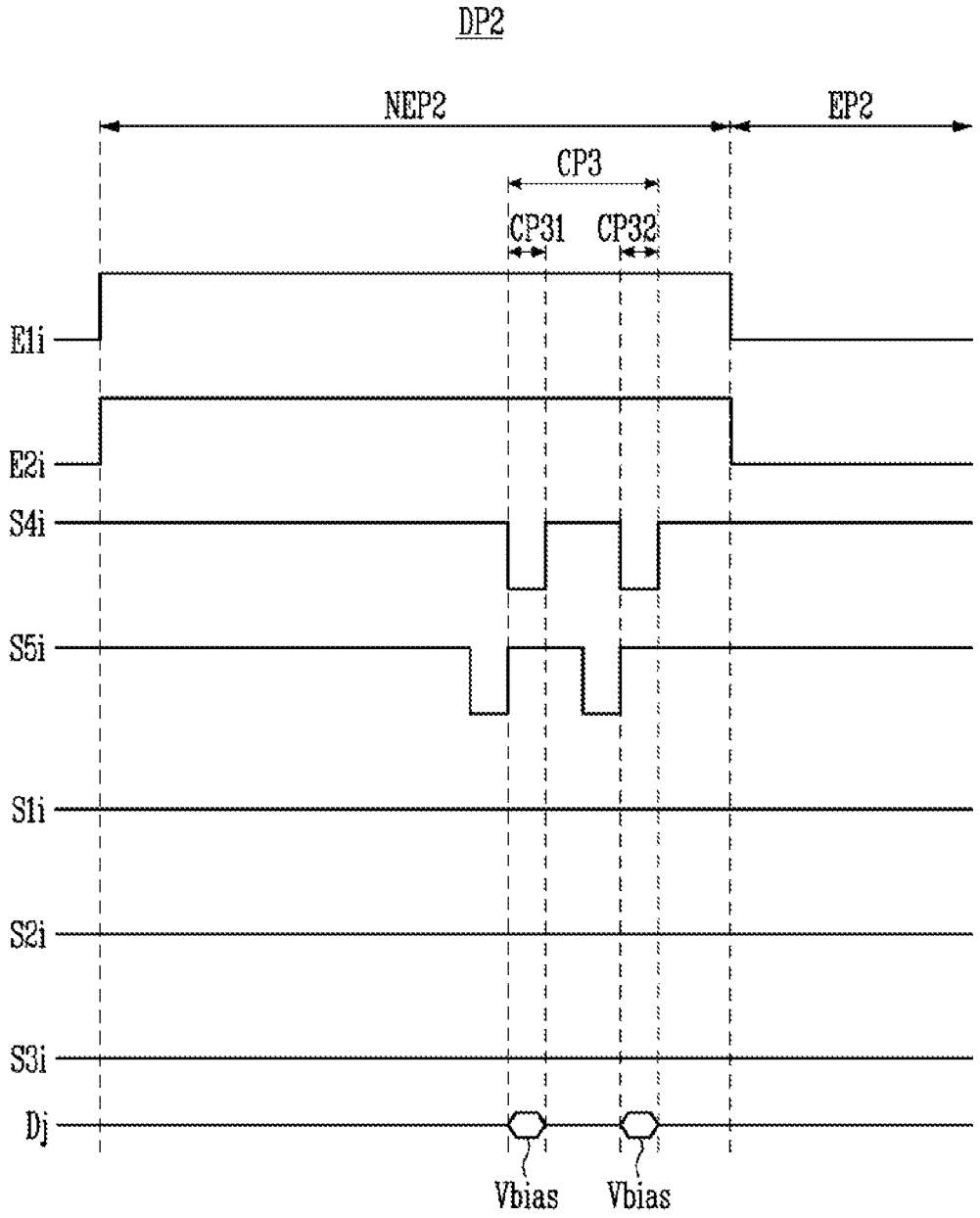
FIG. 6A is a timing diagram illustrating signals supplied to the pixel of the display device in a second driving period in accordance with an embodiment of the present disclosure.
Figure 6B:
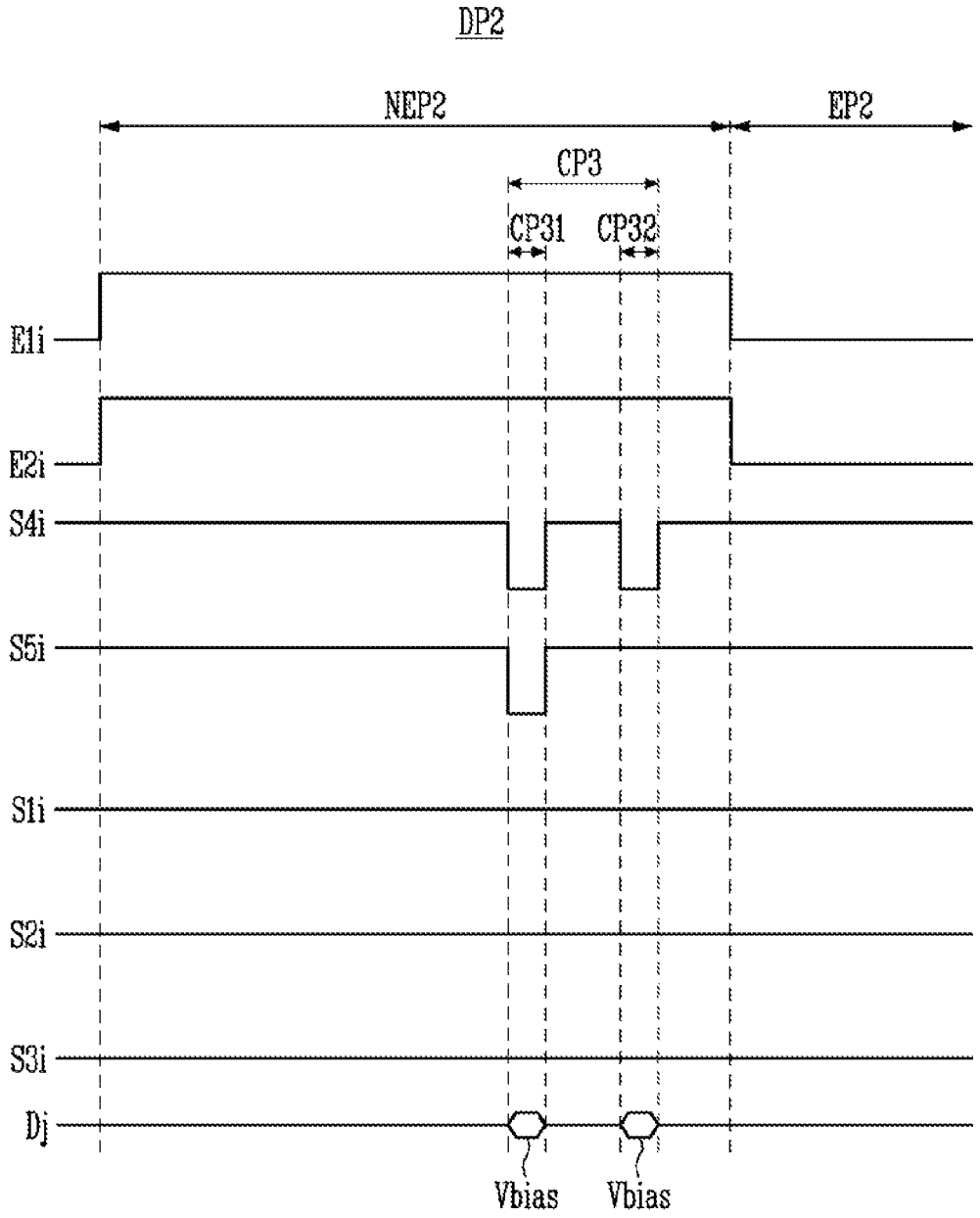
FIG. 6B is a timing diagram illustrating signals supplied to the pixel of the display device in the second driving period in accordance with an embodiment of the present disclosure.

FIG. 6A is a timing diagram illustrating signals supplied to the pixel PX of the display device 1000 in a second driving period DP2 in accordance with an embodiment of the present disclosure. FIG. 6B is a timing diagram illustrating signals supplied to the pixel PX of the display device 1000 in the second driving period DP2 in accordance with an embodiment of the present disclosure.

Referring to FIGS. 5A, 5B, 6A, and 6B, the pixel PX may operate during the first driving period DP1 and the second driving period DP2.

In an embodiment, in variable frequency driving in which a frame frequency is controlled, one frame period may include the first driving period DP1. The second driving period DP2 may be performed at least once according to a frame frequency.

In an embodiment, the first driving period DP1 includes a first non-emission period NEP1 and a first emission period EP1. The second driving period DP2 includes a second non-emission period NEP2 and a second emission period EP2.

Each of the first and second non-emission periods NEP1 and NEP2 may mean a period in which a path of a driving current flowing from the first power line PL1 to the second power line PL2 via the light emitting element LD is blocked, and each of the first and second emission periods EP1 and EP2 may mean a period in which the light emitting element LD emits light, based on the driving current, as the path of the driving current is formed.

In an embodiment, the first driving period DP1 includes a period (e.g., a second period P2) in which a data signal corresponding to an output image is actually written. In the second driving period DP2, the data signal is not supplied, and the fourth scan signal may be supplied to control the first transistor T1 of the pixel PX to be in an on-bias state. In the second driving period DP2, the fifth scan signal may be supplied to initialize the light emitting element LD.

Referring to FIGS. 5A and 5B, the first non-emission period NEP1 includes first and second periods P1 and P2 and first and second compensation periods CP1 and CP2. In an embodiment, the first compensation period CP1 does not overlap with the second period P2.

In an embodiment, a width of the third scan signal is greater than a width of each of the first scan signal, the second scan signal, the fourth scan signal, and the fifth scan signal.

In an embodiment, a width of the fourth scan signal supplied to the fourth scan line S4*i* is equal to a width of the fifth scan signal supplied to the fifth scan line S5*i*.

Referring to FIG. 5A, the fourth scan signal may be a signal shifted from the fifth scan signal. For example, the signal in FIG. 5A depicted next to 'S4*i*' (i.e., a fourth scan line) corresponds to the fourth scan signal and the signal in FIG. 5A depicted next to 'S5*i*' (i.e., the fifth scan line) corresponds to the fifth scan signal. A width of a period (e.g., the second period P2) in which the fourth scan signal is maintained at a low level (or gate-on level) and a width of a period in which the fifth scan signal is maintained at a low level (or gate-on level) may be the same. As described with reference to FIG. 3, the fourth scan line S4*i* may share a scan signal with the fifth scan line S5*i* of an (i+1)th pixel row. Since the fourth scan line S4*i* shares the scan signal with the fifth scan line S5*i* as described above, the line complexity of the display device (i.e., the display device 1000 shown in FIG. 1) can be reduced, and the manufacturing cost of the display device can be reduced.

Referring to FIG. 5B, each scan signal may be supplied from each individual scan driver which does not share any scan signal with the fourth scan line S4*i* and the fifth scan line S5*i*. Although it is illustrated that a period in which the fifth scan signal is maintained at the low level does not overlap with the second period P2 in which the fourth scan signal is maintained at the low level, embodiments of the present disclosure are not limited thereto. For example, the period in which the fifth scan signal is maintained at the low level and the second period P2 may overlap with each other.

Although a case where the width of the fourth scan signal supplied to the fourth scan line S4*i* is different from a width of the first scan signal supplied to the first scan line S1*i* (e.g., a case where the width of the fourth scan signal is smaller than the width of the first scan signal) is illustrated in FIGS. 5A and 5B, embodiments of the present disclosure are not limited thereto.

In an embodiment, the third, fourth, and fifth transistors T3, T4, and T5 may include an n-type oxide semiconductor transistor. The second, first, and third scan signals respectively supplied to the third, fourth, and fifth transistors T3, T4, and T5 may have a high level.

The first, second, sixth, seventh, and eighth transistors T1, T2, T6, T7, and T8 may include a p-type poly-silicon semiconductor transistor. The fourth and fifth scan signals respectively supplied to the second and eighth transistors T2 and T8 may have a low level.

In an embodiment, a waveform of the first emission control signal (e.g., see signal depicted in FIG. 5A next to 'E1*i*') supplied in the first non-emission period NEP1 is different from a waveform of the second emission control signal (e.g., see signal depicted in FIG. 5A next to 'E2*i*') supplied in the first non-emission period NEP1. For example, a width of the second emission control signal may be greater than a width of the first emission control signal.

In an embodiment, the second emission control signal maintains a high level from a time at which the first non-emission period NEP1 is started from a time at which the first non-emission period NEP1 is ended. In this period, the seventh transistor T7 may be maintain a turn-off state by the second emission control signal having the high level (or gate-off level).

In an embodiment, the first emission control signal maintains a low level (or gate-on level) during the first compensation period CP1 in the first non-emission period NEP1, and the sixth transistor T6 may be maintained in the turn-on state by the first emission control signal. The sixth transistor T6 may be set to the turn-off state by the first emission control signal during the first non-emission period NEP1 except during the first compensation period CP1.

In an embodiment, in the first period P1, the fourth transistor T4 is turned on by the first scan signal, and the third power voltage Vint1 is supplied to the third node N3. Therefore, the voltage of the third node N3 (i.e., a gate voltage of the first transistor T1) may be initialized to the third power voltage Vint1. A voltage of a data signal of a previous frame (hereinafter, referred to as a previous data voltage) may be substantially maintained at the fourth node N4. The first period P1 is a period in which the voltage of the third node N3 is initialized, and may be referred to as a first initialization period.

In an embodiment, the fourth transistor T4 is turned off after the first period P1.

In an embodiment, after the first period P1, the second scan signal is supplied to the second scan line S2*i*, and the third transistor T3 is turned on. The supply of the second scan signal may be maintained until before the second period P2.

In an embodiment, after the first period P1, the third scan signal is supplied to the third scan line S3*i*, and the fifth transistor T5 is turned on. The supply of the third scan signal may be maintained until before the second compensation period CP2.

In an embodiment, in the first compensation period CP1, the supply of the first emission control signal to the first emission control line E1*i* is suspended (e.g., set to a low level), and the sixth transistor T6 is turned on. Therefore, a current path reaching the fourth node N4 via the sixth transistor T6 and the fifth transistor T5 from the first power line PL1 may be formed, and the first power voltage VDD may be supplied to the fourth node N4.

In an embodiment, since the third transistor T3 is in the turn-on state in the first compensation period CP1, the first transistor T1 may be connected in the diode form, and the threshold voltage of the first transistor T1 may be compensated. That is, the first compensation period CP1 may be determined by the length of a period in which the first emission control signal is not supplied. For example, the first compensation period CP1 may be set as two horizontal periods 2H or longer. A horizontal period H may correspond to period during which data signals are output to a single row of the pixel unit 100. Thus, a sufficient threshold voltage compensation time can be secured. However, this is merely illustrative. The length of the first compensation period CP1 is not limited thereto, and may be variously designed and modified according to a driving condition, and the like.

In an embodiment, in the first compensation period CP1, the voltage of the fourth node N4 may be changed from the previous data voltage to the first power voltage VDD. In an embodiment, the voltage of the third node N3 may be changed to a difference between the first power voltage VDD and the threshold voltage of the first transistor T1 (hereinafter, referred to as Vth) (e.g., VDD-Vth). Therefore, the threshold voltage Vth may be stored in the second capacitor C2.

In an embodiment, when the first emission control signal is again supplied, the sixth transistor T6 is turned off, and the first compensation period CP1 is ended.

In an embodiment, after the first compensation period CP1, the supply of the second scan signal is suspended, and the third transistor T3 is turned off. However, this is merely illustrative, and the suspension of the supply of the second scan signal may be simultaneously performed with the end of the first compensation period CP1.

In an embodiment, since the fifth scan signal is supplied before the second period P2, the eighth transistor T8 may be turned on. When the eighth transistor T8 is turned on, the fourth power voltage Vint2 may be supplied to the fifth node N5.

In an embodiment, in the second period P2, the fourth scan signal is supplied to the fourth scan line S4*i*, and the second transistor T2 is turned on. Also, in the second period P2, the fifth transistor T5 may be in the turned on state. Therefore, a data signal voltage corresponding to a data signal of a current data frame (hereinafter, referred to as a current data voltage Vdata) may be supplied to the fourth node N4 via the second transistor T2 and the fifth transistor T5 from the data line Dj.

In an embodiment, the voltage of the fourth node N4 is changed from the first power voltage VDD to the current data voltage Vdata, and the third node N3 may have a value obtained by reflecting the coupling to the difference between the first power voltage VDD and the threshold voltage Vth of the first transistor T1 (e.g., VDD−Vth+(Vdata−VDD)). That is, only a value of Vdata-Vth may be left as the voltage of the third node N3, and then the driving current may have a value corresponding to the data voltage Vdata. The second period P2 is a period in which the voltage of the fourth node N4 is written as the data voltage, and may be referred to as a data writing period.

In an embodiment, a pulse width of the first emission control signal is equal to or greater than pulse widths of the fourth scan signal. That is, the first compensation period CP1 may be equal to or longer than the second period P2.

In an embodiment, after the second period P2, the supply of the third scan signal is suspended, and the fifth transistor T5 is turned off. Therefore, each of the voltages of the third node N3 and the fourth node N4 may be maintained. However, this is merely illustrative, and the supply of the third scan signal may be suspended at the same time when the second period P2 is ended.

In an embodiment, after the second period P2, the supply of the fourth scan signal is suspended, and the second transistor T2 is turned off. After the second period P2, as the supply of the fourth scan signal is suspended, the supply of the current data voltage Vdata to the fourth node N4 may be suspended.

In an embodiment, in the second compensation period CP2, the fourth scan signal is supplied to the fourth scan line S4*i*, and the second transistor T2 is turned on. Also, in the second compensation period CP2, the fifth transistor T5 may be in the turn-off state. A bias voltage Vbias may be supplied to the first node N1 via the second transistor T2 from the data line Dj. That is, the bias voltage Vbias may be supplied to the first node N1 by the turn-on of the second transistor T2, and the first transistor T1 may be controlled to be in the on-bias state before light is emitted. In an embodiment, the bias voltage Vbias supplied in the second compensation period CP2 is a data signal supplied to a pixel located on another row, but the present disclosure is not limited thereto.

In an embodiment, in the second period P2, the second transistor T2 and the fifth transistor T5 are turned on, and therefore, the data voltage Vdata corresponding to the data signal is supplied to the fourth node N4 via the second transistor T2 and the fifth transistor T5 from the data line Dj. As compared with this, in the second compensation period CP2, the second transistor T2 and the fifth transistor T5 may be turned on, and the bias voltage Vbias may be supplied to the first node N1 (i.e., a source electrode of the first transistor T1) from the data line Dj.

Referring to FIG. 5A, the fourth scan signal may correspond to a signal shifted or delayed from the fifth scan signal. In an example, the fifth scan line S5*i* connected to the ith pixel row may be connected to the fourth scan lines S4*i* connected to the (i−1)th pixel row. That is, the fourth scan line S4*i* and the fifth scan line S5*i* may share a scan signal with each other.

Referring to FIG. 5A, since the fifth scan signal is supplied before the second compensation period CP2, the eighth transistor T8 may be turned on. When the eighth transistor T8 is turned on, the fourth power voltage Vint2 may be supplied to the fifth node N5.

Referring to FIG. 5B, since the fifth scan signal is supplied in the second compensation period CP2, the eighth transistor T8 may be turned on. When the eighth transistor T8 is turned on, the fourth power voltage Vint2 may be supplied to the fifth node N5.

In an embodiment, by the turn-on of the eighth transistor T8, the fourth power voltage Vint2 may be supplied to the fifth node N5, and the parasitic capacitor of the light emitting element LD may be discharged.

In an embodiment, after the second compensation period CP2, the supply of the first and second emission control signals is suspended. Therefore, the first non-emission period NEP1 may be ended, and the first emission period EP1 may be performed. The sixth and seventh transistors T6 and T7 may be turned on in the first emission period EP1.

In an embodiment, in the first emission period EP1, a driving current corresponding to the current data voltage Vdata written in the second period P2 is supplied to the light emitting element LD, and the light emitting element LD may emit light, based on the driving current.

Referring to FIGS. 6A and 6B, the second driving period DP2 may include the second non-emission period NEP2 and the second emission period EP2.

In an embodiment, during the second non-emission period NEP2, the first and second emission control signals may be supplied without any pause or suspension. That is, during the second non-emission period NEP2, the first and second emission control signals may have a high level. In an example, during the second non-emission period NEP2, the sixth transistor T6 and the seventh transistor T7 may be turned off. For example, while the first emission control signal may have a low level during a portion of the first non-emission period NEP1 in FIG. 5A and FIG. 5B, the first emission control signal may constantly have a high level throughout the second non-emission period NEP2 in FIG. 6A and FIG. 6B.

In an embodiment, in the second non-emission period NEP2, the first to third scan signals are not supplied, and the third to fifth transistors T3 to T5 may be in the turn-off state. For example, the first to third scan signals may maintain a low level throughout the second non-emission period NEP2.

In an embodiment, in the second non-emission period NEP2, the fourth scan signal is supplied a plurality of times to the fourth scan line S4*i*. For example, the fourth scan signal may include several pulses or transitions during the second non-emission period NEP2.

Referring to FIGS. 6A and 6B, in a third compensation period CP3 of the second non-emission period NEP2, the fourth scan signal may be output a plurality of times. As the second transistor T2 is turned on a plurality of times since the fourth scan signal is supplied a plurality of times in the second non-emission period NEP2, the bias voltage Vbias may be cyclically applied from the data line Dj, so that display quality deterioration according to a change in hysteresis characteristic of the first transistor T1 can be prevented. In addition, the pixel PX is driven by using the first and second driving periods DP1 and DP2, so that image quality at various frame frequencies can be increased.

However, although it is illustrated that the fourth scan signal is supplied twice in the second non-emission period NEP2, the fourth scan signal may be supplied once or three times or more.

FIG. 6A is a diagram illustrating the second driving period DP2 with respect to the first driving period DP1 shown in FIG. 5A.

Referring to FIGS. 5A and 6A, the fourth scan signal may correspond to a signal shifted or delayed from the fifth scan signal. In an example, the fifth scan line S5*i* connected to the ith pixel row may be connected to the fourth scan line S4*i* connected to the (i−1)th pixel row. That is, the fourth scan line S4*i* and the fifth scan line S5*i* may share a scan signal with each other.

Referring to FIGS. 5A and 6A, before a (3-1)th compensation period CP31 and a (3-2)th compensation period CP32, in which the fourth scan signal is supplied, the fifth scan signal may be supplied to the fifth scan line S5*i*, and the eighth transistor T8 may be turned on. When the eighth transistor T8 is turned on, the fourth power voltage Vint2 may be supplied to the fifth node N5.

FIG. 6B is a diagram illustrating the second driving period DP2 with respect to the first driving period DP1 shown in FIG. 5B.

Referring to FIGS. 5B and 6B, in the first driving period DP1 and the second driving period DP2, the fifth scan signal may be periodically supplied to the fifth scan line S5*i*, and the eighth transistor T8 may be turned on.

In an embodiment, due to the turn-on of the eighth transistor T8, the fourth power voltage Vint2 may be supplied to the fifth node N5, and the parasitic capacitor of the light emitting element may be discharged.

Figure 7:
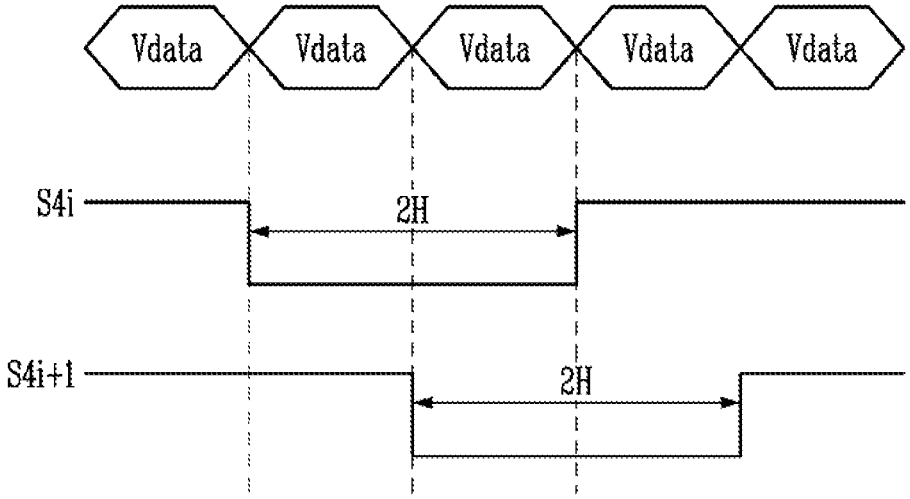
FIG. 7 illustrates a fourth scan line and data signal supplied through a data line in accordance with an embodiment of the present disclosure.

FIG. 7 illustrates data signals through the fourth scan line S4*i* and the data line Dj in accordance with an embodiment of the present disclosure.

Referring to FIGS. 5A, 5B, and 7, in the second period P2 of the first non-emission period NEP1, the fourth scan signal may be supplied through the fourth scan line S4*i*, so that the second transistor T2 is turned on. As the second transistor T2 and the fifth transistor T5 are turned on in the second period P2, a data signal may be supplied from the data line Dj, so that a data voltage Vdata corresponding to the data signal is supplied to the fourth node N4. The second period P2 may be set to two horizontal periods 2H or longer. A (i+1)th fourth scan signal supplied to an (i+1)th fourth scan line S4*i*+1 may overlap with the fourth scan signal supplied to the fourth scan line S4*i* in one horizontal period 1H.

Figure 8A:
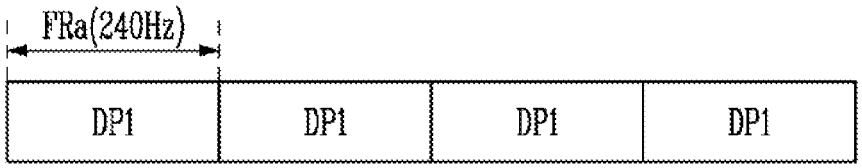
FIGS. 8A to 8C are diagrams illustrating examples of driving of the display device according to a frame frequency in accordance with an embodiment of the present disclosure.
Figure 8B:
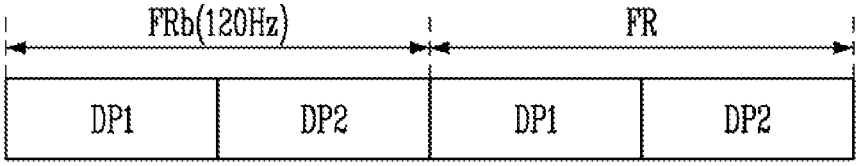
Figure 8C:
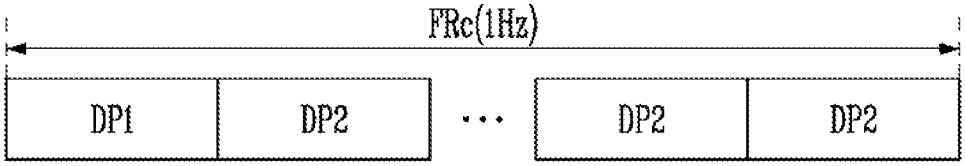

FIGS. 8A to 8C are diagrams illustrating examples of driving of the display device 1000 according to a frame frequency in accordance with an embodiment of the present disclosure.

Referring to FIGS. 1 and 8A to 8C, the display device 1000 may be driven at various frame frequencies.

In an embodiment, a frequency of the first driving period DP1 may correspond to a frame frequency.

In an embodiment, as shown in FIG. 8A, a first frame Fra may include the first driving period DP1. For example, when the frequency of the first driving period DP1 is 240 Hz, the first frame Fra may be driven at 240 Hz. In other words, the length of the first driving period DP1 and the first frame Fra may be about 4.17 ms.

In an embodiment, as shown in FIG. 8B, a second frame FRb may include the first driving period DP1 and one second driving period DP2. For example, the first driving period DP1 and the one second driving period DP2 may be repeated. The second frame FRb may be driven at 120 Hz. In other words, the length of the first driving period DP1 and the one second driving period DP2 may be about 4.17 ms, and the length of the second frame FRb may be about 8.33 ms.

In an embodiment, as shown in FIG. 8C, a third frame FRc may include one first driving period DP1 and a plurality of repeated second driving periods DP2. For example, when the third frame FRc is driven at 1 Hz, the length of the third frame FRc may be about 1 second, and the second driving period DP2 in the third frame FRc may be repeated about 239 times.

As described above, the number of times the second driving period DP2 is repeated in one frame is controlled, so that the display device 1000 can be freely driven at various frame frequencies (e.g., 1 Hz to 480 Hz).

Figure 9:
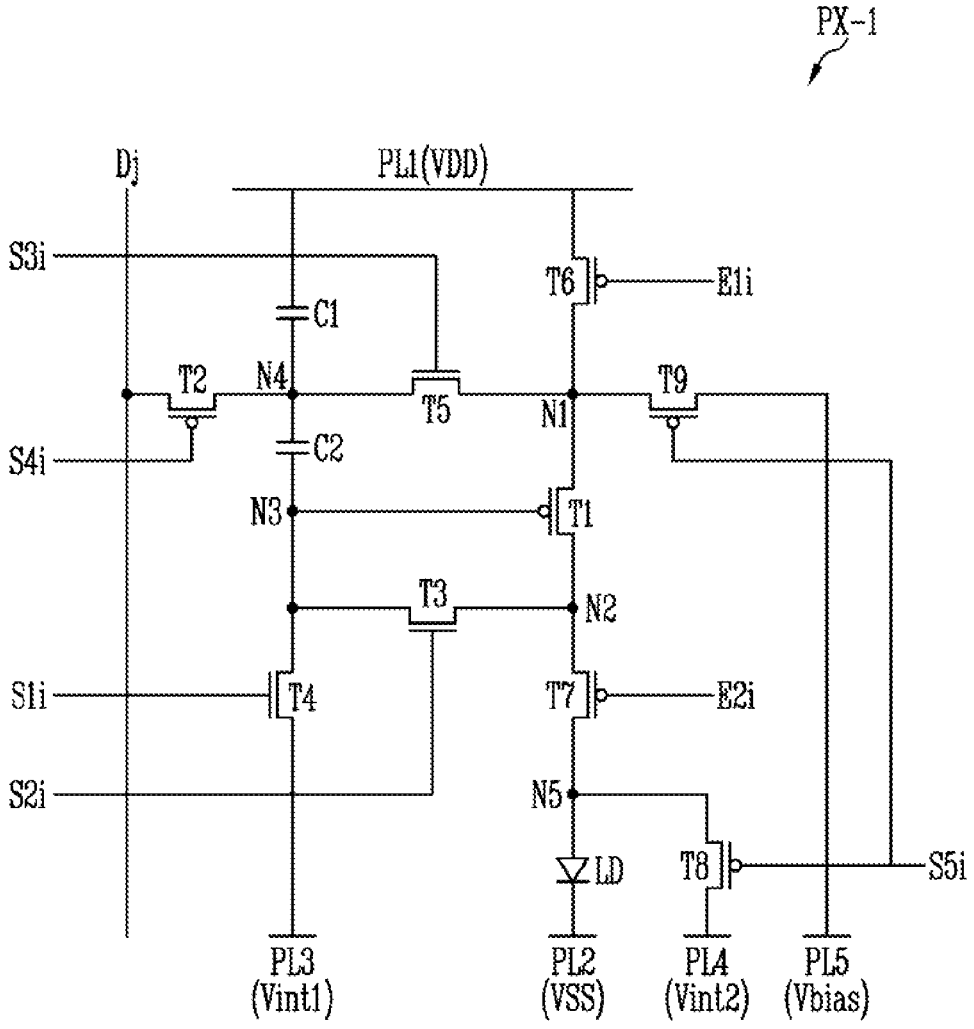
FIG. 9 is a circuit diagram illustrating an example of a pixel included in the display device in accordance with an embodiment of the present disclosure.

FIG. 9 is a circuit diagram illustrating an example of a pixel PX−1 included in the display device 1000 in accordance with an embodiment of the present disclosure. For example, the pixel PX of FIG. 3 may be replaced with the pixel PX−1 of FIG. 9.

The pixel PX−1 shown in FIG. 9 are configured and operated identically to the pixel PX described with reference to FIG. 4, except a second transistor T2 and a ninth transistor T9. Therefore, components identical or corresponding to those described with reference to FIG. 4 are designated by like reference numerals, and overlapping descriptions will be omitted.

Referring to FIGS. 1 and 9, the pixel PX−1 may include a light emitting element LD, first to ninth transistors T1 to T9, a first capacitor C1, and a second capacitor C2.

In an embodiment, the second transistor T2 is connected between a jth data line Dj (hereinafter, referred to as a data line) and the fourth node N4. A gate electrode of the second transistor T2 may be connected to an ith fourth scan line S4*i* (hereinafter, referred to as a fourth scan line). The second transistor T2 may be turned on when the fourth scan signal is supplied to the fourth scan line S4*i*, to electrically connect the data line Dj and the fourth node N4 to each other.

In an embodiment, the ninth transistor T9 is connected between the first node N1 and a fifth power line PL5 through which the fifth power voltage Vbias is provided. A gate electrode of the ninth transistor T9 may be connected to an ith fifth scan line S5*i* (hereinafter, referred to as a fifth scan line). The ninth transistor T9 may be turned on when the fifth scan signal is supplied to the fifth scan line S5*i*, to provide the fifth power voltage Vbias to the first node N1.

In an embodiment, the gate electrode of the ninth transistor T9 and the gate electrode of the eighth transistor T8 are connected to the fifth scan line S5*i*. Therefore, when the fifth scan signal is supplied to the fifth scan line S5*i*, the eighth transistor T8 and the ninth transistor T9 may be turned on. In an embodiment, the fourth power voltage Vint2 and the fifth power voltage Vbias are simultaneously provided respectively to the fifth node N5 and the first node N1.

Figure 10:
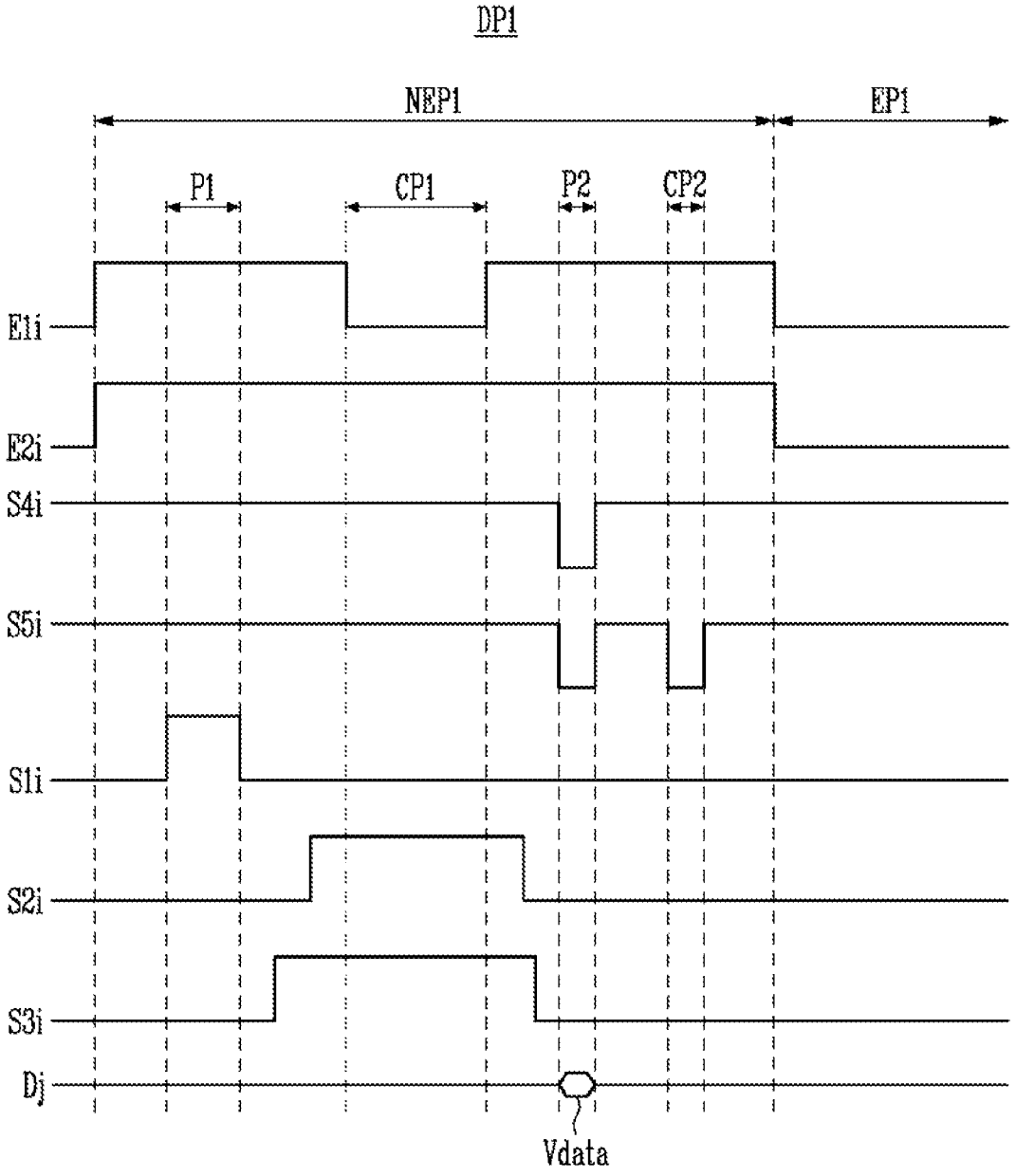
FIG. 10 is a timing diagram illustrating signals supplied to the pixel of the display device in a first driving period in accordance with an embodiment of the present disclosure.
Figure 11:
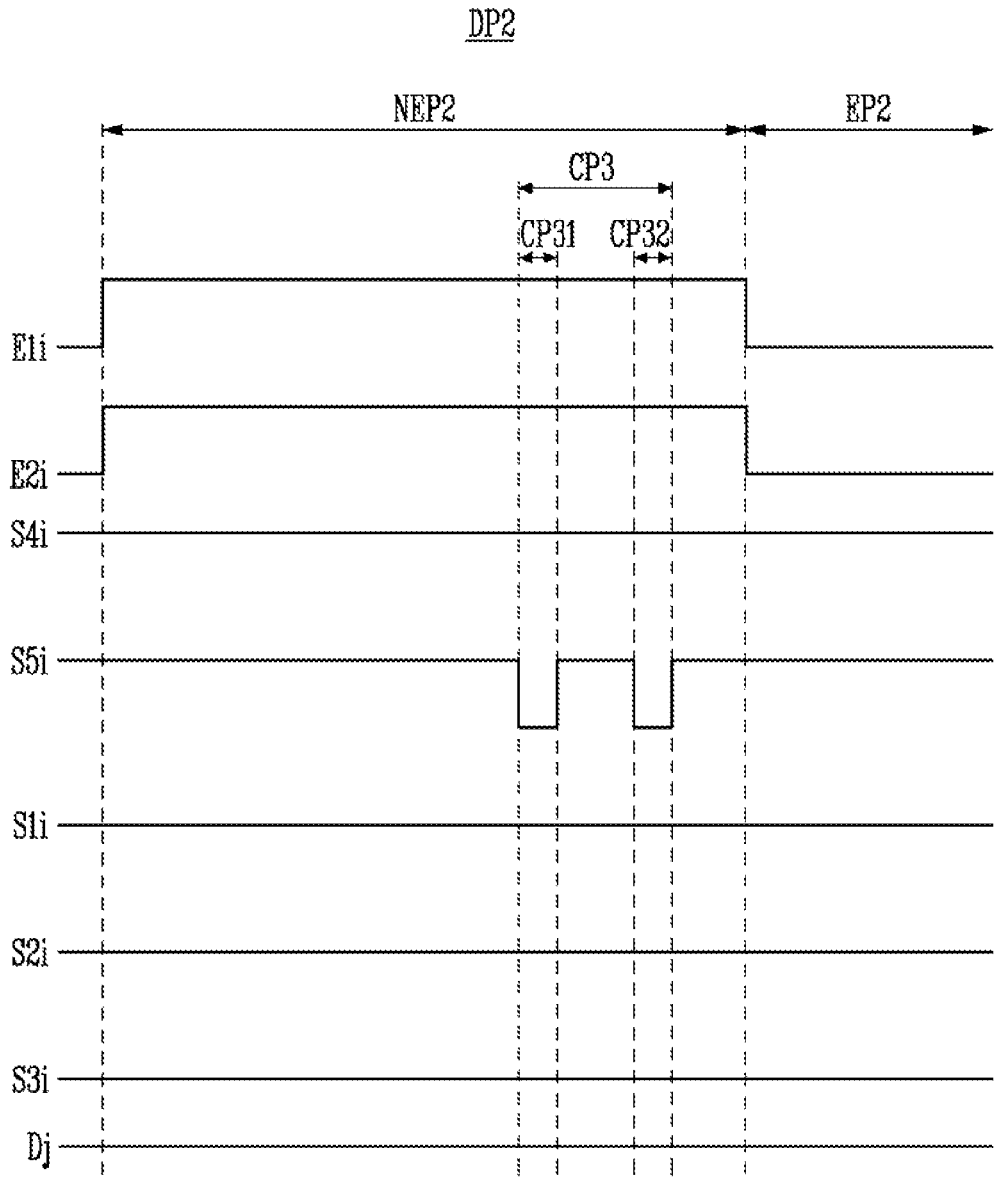
FIG. 11 is a timing diagram illustrating signals supplied to the pixel of the display device in a second driving period in accordance with an embodiment of the present disclosure.

FIG. 10 is a timing diagram illustrating signals supplied to the pixel PX−1 of the display device 1000 in a first driving period DP1 in accordance with an embodiment of the present disclosure. FIG. 11 is a timing diagram illustrating signals supplied to the pixel PX−1 of the display device 1000 in a second driving period DP2 in accordance with an embodiment of the present disclosure.

Referring to FIGS. 10 and 11, the pixel PX−1 may operate through the first driving period DP1 and the second driving period DP2.

In an embodiment, in variable frequency driving in which a frame frequency is controlled, one frame period may include the first driving period DP1. The second driving period DP2 may be performed at least once according to a frame frequency.

In an embodiment, the first driving period DP1 includes a first non-emission period NEP1 and a first emission period EP1. The second driving period DP2 may include a second non-emission period NEP2 and a second emission period EP2.

Each of the first and second non-emission periods NEP1 and NEP2 may mean a period in which a path of a driving current flowing from the first power line PL1 to the second power line PL2 via the light emitting element LD is blocked, and each of the first and second emission periods EP1 and EP2 may mean a period in which the light emitting element LD emits light, based on the driving current, as the path of the driving current is formed.

In an embodiment, the first driving period DP1 includes a period (e.g., a second period P2) in which a data signal corresponding to an output image is actually written. In the second driving period DP2, the data signal is not supplied, and the fifth scan signal may be supplied to control the first transistor T1 of the pixel PX−1 to be in the on-bias state. In the second driving period DP2, the fifth scan signal may be supplied to initialize the light emitting element LD.

Referring to FIG. 10, the first non-emission period NEP1 may include first and second periods P1 and P2 and first and second compensation periods CP1 and CP2. In an embodiment, the first compensation period CP1 does not overlap with the second period P2.

Referring to FIG. 10, scan signals output from scan drivers distinguished from each other may be respectively supplied to the fourth scan line S4*i* to which the fourth scan signal is supplied and the fifth scan line S5*i* to which the fifth scan signal is supplied.

In an embodiment, the fourth scan line S4*i* and the fifth scan line S5*i* share a scan signal with each other. For example, the fifth scan line S5*i* connected to the ith pixel row may be connected to the fourth scan line S4*i* connected to the (i−1)th pixel row. In an example, the fourth scan signal may correspond to a signal shifted or delayed from the fifth scan signal.

In an embodiment, the third, fourth, and fifth transistors T3, T4, and T5 may include an n-type oxide semiconductor transistor. The second, first, and third scan signals respectively supplied to the third, fourth, and fifth transistors T3, T4, and T5 may have a high level.

In an embodiment, the first, second, sixth, seventh, eighth, and ninth transistors T1, T2, T6, T7, T8, and T9 may include a p-type poly-silicon semiconductor transistor. The fourth scan signal and the fifth scan signal supplied to the second, eighth, and ninth transistors T2, T8, and T9 may have a low level.

In FIG. 10, the pixel PX−1 in the other timing diagram except a timing diagram from the second period P2 to the second compensation period CP2 is configured and operated identically to the pixel PX described with reference to FIGS. 5A and 5B. Therefore, components identical or corresponding to those described with reference to FIGS. 5A and 5B are designated by like reference numerals, and overlapping descriptions will be omitted.

In an embodiment, in the second period P2, the fourth scan signal is supplied to the fourth scan line S4*i*, and the second transistor T2 may be turned on. Since the second transistor T2 is turned on, a data signal voltage Vdata corresponding to a data signal of a current data frame may be supplied to the fourth node N4 from the data line Dj.

In an embodiment, the voltage of the fourth node N4 is changed from the first power voltage VDD to the current data voltage Vdata, and the third node N3 may have a value obtained by reflecting the coupling to the difference between the first power voltage VDD and the threshold voltage Vth of the first transistor T1 (e.g., VDD−Vth+(Vdata−VDD)). That is, only a value of Vdata-Vth may be left as the voltage of the third node N3, and then the driving current may have a value corresponding to the data voltage Vdata. The second period P2 is a period in which the voltage of the fourth node N4 is written as the data voltage, and may be referred to as a data writing period.

In an embodiment, the fifth scan signal is supplied a plurality of times in the first non-emission period NEP1 of the first driving period DP1.

In an embodiment, when the fifth scan signal is supplied to the fifth scan line S5*i* in the second period P2, the eighth transistor T8 and the ninth transistor T9 may be turned on. In an example, since the eighth transistor T8 is turned on, the fourth power voltage Vint2 may be supplied to the fifth node N5. Since the ninth transistor T9 is turned on, the fifth power voltage Vbias may be supplied to the first node N1. The fifth power voltage Vbias may be supplied to the first node N1, and the first transistor T1 may be controlled to be in the on-bias state before light is emitted.

In an embodiment, after the second period P2, the supply of the fourth scan signal may be suspended, and the second transistor T2 may be turned off. After the second period P2, since the supply of the fourth scan signal is suspended, the supply of the current data voltage Vdata to the fourth node N4 may be suspended. For example, the suspension of the fourth scan signal may mean that the fourth scan signal has been set to a high level.

In an embodiment, in the second compensation period CP2, the fifth scan signal is supplied to the fifth scan line S5*i*, and the eighth transistor T8 and the ninth transistor T9 may be turned on. Due to the turn-on of the ninth transistor T9, the fifth power voltage Vbias may be supplied to the first node N1 of the first transistor T1 from the fifth power line PL5. The first transistor T1 may be controlled to be in the on-bias state before light is emitted.

In an embodiment, due to the turn-on of the eighth transistor T8, the fourth power voltage Vint2 is supplied to the fifth node N5, and the parasitic capacitor of the light emitting element LD may be discharged.

In an embodiment, the first transistor T1 may be cyclically controlled to be in the on-bias state by the fifth scan signal supplied in the second period P2 and the second compensation period CP2.

Referring to FIGS. 9 and 10, the first transistor T1 is controlled to be in the on-bias state through the fifth power voltage Vbias corresponding to a constant voltage, so that the display quality deterioration according to the change in hysteresis characteristic of the first transistor T1 can be further reduced.

In an embodiment, after the second compensation period CP2, the supply of the first and second emission control signals are suspended. Therefore, the first non-emission period NEP1 may be ended, and the first emission period EP1 may be performed. The sixth and seventh transistors T6 and T7 may be turned on in the first emission period EP1.

In an embodiment, in the first emission period EP1, a driving current corresponding to the current data voltage Vdata written in the second period P2 is supplied to the light emitting element LD, and the light emitting element LD may emit light, based on the driving current.

Referring to FIG. 11, the second driving period DP2 may include the second non-emission period NEP2 and the second emission period EP2.

In an embodiment, during the second non-emission period NEP2, the first and second emission control signals may be supplied without any pause. That is, during the second non-emission period NEP2, the first and second emission control signals may have a high level. In an example, during the second non-emission period NEP2, the sixth transistor T6 and the seventh transistor T7 may be turned off.

In an embodiment, in the second non-emission period NEP2, the first to third scan signals are not supplied, and the third to fifth transistors T3 to T5 may be in the turn-off state.

In an embodiment, in the second non-emission period NEP2, the fifth scan signal is supplied a plurality of times to the fifth scan line S5*i*. In an example, the fifth scan signal may be supplied a plurality of times to the fifth scan line S5*i* in a third compensation period CP3 of the second non-emission period NEP2. However, although it is illustrated that the fifth scan signal is supplied twice in the second non-emission period NEP2, the fifth scan signal may be supplied one or three times or more.

In an embodiment, since the fifth scan signal is supplied a plurality of times to the fifth scan line S5*i* in the second non-emission period NEP2, the eighth transistor T8 and the ninth transistor T9 may be turned on. By the turn-on of the eighth transistor T8, the fourth power voltage Vint2 may be supplied to the fifth node N5, and the parasitic capacitor of the light emitting element LD may be discharged. In an example, due to the turn-on of the ninth transistor T9, the fifth power voltage Vbias may be supplied to the first node N1, and the first transistor T1 may be controlled to be in the on-bias state.

In an embodiment, after the third compensation period CP3, the supply of the first and second emission control signals may be suspended. Therefore, the second non-emission period NEP2 may be ended, and the second emission period EP2 may be performed. The sixth and seventh transistors T6 and T8 may be turned on in the second emission period EP2.

In an exemplary embodiment, a pixel includes the light emitting element LD, the first transistor T1, the second transistor T2, the third transistor T3, the fourth transistor T4, the fifth transistor T5, and the sixth transistor T6. The first transistor T1 is connected between the first node N1 and the second node N2 and generates a driving current flowing from the first power line PL1 receiving the first power voltage VDD to the second power line PL2 receiving the second power voltage VSS through the light emitting element LD. The second transistor is connected between a data line and the first node N1 and is turned on in response to a fourth scan signal. The third transistor T3 is connected between the second node N2 and a third node N3 connected to a gate electrode of the first transistor T1 and is turned on in response to a second scan signal. The fourth transistor T4 is connected between the third node N3 and the third power line PL3 receiving the third power voltage Vint1 and is turned on in response to a first scan signal. The fifth transistor is connected between the first node N1 and a fourth node N4 and is turned on in response to a third scan signal. The sixth transistor T6 is connected between the first node N1 and the first power line PL and is turned off in response to a first emission control signal. The scan signals are set so that a period in which the second transistor is turned on and a period in which the third transistor is turned on do not overlap with each other.

In a pixel and a display device including the same in accordance with an embodiment of the present disclosure, a data writing period and a period for compensating a threshold voltage of a driving transistor are separated from each other, so that a sufficient compensation time can be secured when the display device is driven at a high frame frequency (e.g., 240 Hz).

Also, in the pixel and the display device including the same in accordance with an embodiment of the present disclosure, by controlling an emission control signal and a scan signal, a period for threshold voltage compensation can be secured while eliminating influence caused by a data signal of a previous frame. In addition, a bias voltage may be cyclically applied to the driving transistor, so that display quality deterioration according to a change in hysteresis characteristic of the driving transistor can be prevented.

Example embodiments have been disclosed herein, and although specific terms are employed, they are used and are to be interpreted in a generic and descriptive sense only and not for purpose of limitation. In some instances, as would be apparent to one of ordinary skill in the art, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as set forth in the following claims.

What is claimed is:

1. A display device comprising:

a pixel connected to first to fifth scan lines, a first emission control line, and a data line;

a scan driver configured to supply first to fifth scan signals respectively to the first to fifth scan lines;

an emission driver configured to supply a first emission control signal to the first emission control line; and a data driver configured to supply a data signal to the data line, wherein the pixel comprises:

a light emitting element;

a first transistor connected between a first node and a second node, the first transistor generating a driving current flowing from a first power line receiving a first power voltage to a second power line receiving a second power voltage through the light emitting element;

a second transistor connected between the data line and the first node, the second transistor being turned on in response to the fourth scan signal;

a third transistor connected between the second node and a third node connected to a gate electrode of the first transistor, the third transistor being turned on in response to the second scan signal;

a fourth transistor connected between the third node and a third power line through which a third power voltage is provided, the fourth transistor being turned on in response to the first scan signal;

a fifth transistor connected between the first node and a fourth node, the fifth transistor being turned on in response to the third scan signal;

a sixth transistor connected between the first node and the first power line, the sixth transistor being turned off in response to the first emission control signal;

a first capacitor connected between the first power line and the fourth node; and a second capacitor connected between the third node and the fourth node, and wherein the emission driver sets the scan signals so that a period in which the second transistor is turned on and a period in which the third transistor is turned on do not overlap with each other.

2. The display device of claim 1, wherein the pixel further comprises:

a seventh transistor connected between the second node and a first electrode of the light emitting element, wherein the emission driver applies a second emission control signal to a second emission control line to turn off the seventh transistor; and an eighth transistor connected between a fifth node connected to the first electrode of the light emitting element and a fourth power line receiving a fourth power voltage, wherein the emission driver sets the fifth scan signal to turn on the eighth transistor.

3. The display device of claim 2, wherein a first non-emission period of one frame includes a first compensation period in which the first emission control signal is not supplied to the sixth transistor and the second scan signal is supplied to the third transistor and a data writing period in which the first emission control signal is supplied to the sixth transistor and the fourth scan signal is supplied to the second transistor, so that the data voltage supplied to the data line is written to the fourth node.

4. The display device of claim 3, wherein the first non-emission period of the one frame includes a second compensation period in which the fourth scan signal is supplied to the second transistor, so that a bias voltage is transferred to the first transistor through the data line.

5. The display device of claim 4, wherein the fifth transistor is turned on when the third scan signal is supplied in the first compensation period and the data writing period, and is turned off when the third scan signal is not supplied in the second compensation period.

6. The display device of claim 4, wherein, in a second non-emission period of the one frame, the scan driver supplies the fourth signal a plurality of times to the fourth scan line.

7. The display device of claim 6, wherein, in the second non-emission period of the one frame, the fourth scan signal supplied a plurality of times is supplied to the second transistor, so that the bias voltage is transferred to the first transistor through the data line.

8. The display device of claim 1, wherein each of the third transistor, the fourth transistor, and the fifth transistor is an oxide semiconductor transistor.

9. The display device of claim 2, wherein a pulse width of the first emission control signal is equal to or greater than pulse widths of the fourth scan signal.

10. The display device of claim 2, wherein the fourth scan signal is a signal shifted from the fifth scan signal.

11. A pixel comprising:

a light emitting element;

a first transistor connected between a first node and a second node, the first transistor generating a driving current flowing from a first power line receiving a first power voltage to a second power line receiving a second power voltage through the light emitting element;

a second transistor connected between a data line and the first node, the second transistor being turned on in response to a fourth scan signal;

a third transistor connected between the second node and a third node connected to a gate electrode of the first transistor, the third transistor being turned on in response to a second scan signal;

a fourth transistor connected between the third node and a third power line receiving a third power voltage, the fourth transistor being turned on in response to a first scan signal;

a fifth transistor connected between the first node and a fourth node, the fifth transistor being turned on in response to a third scan signal;

a sixth transistor connected between the first node and the first power line, the sixth transistor being turned off in response to a first emission control signal;

a first capacitor connected between the first power line and the fourth node; and a second capacitor connected between the third node and the fourth node, and wherein the scan signals are set so that a period in which the second transistor is turned on and a period in which the third transistor is turned on do not overlap with each other.

12. The pixel of claim 11, further comprising:

a seventh transistor connected between the second node and a first electrode of the light emitting element, the seventh transistor being turned off in response to a second emission control signal supplied to a second emission control line; and an eighth transistor connected between a fifth node connected to the first electrode of the light emitting element and a fourth power line through which a fourth power voltage is provided, the eighth transistor being turned on in response to a fifth scan signal.

13. The pixel of claim 12, wherein a first non-emission period of one frame includes a first compensation period in which the first emission control signal is supplied to the sixth transistor and the second scan signal is supplied to the third transistor and a data writing period in which the first emission control signal is not supplied to the sixth transistor and the fourth scan signal is supplied to the second transistor, so that the data voltage supplied to the data line is written to the fourth node.

14. The pixel of claim 13, wherein the first non-emission period of the one frame includes a second compensation period in which the fourth scan signal is supplied to the second transistor, so that a bias voltage is transferred to the first transistor through the data line.

15. The pixel of claim 14, wherein the fifth transistor is turned on when the third scan signal is supplied in the first compensation period and the data writing period, and the fifth transistor is turned off when the third scan signal is not supplied in the second compensation period.

16. A display device comprising:

a pixel connected to first to fifth scan lines, a first emission control line, and a data line;

a scan driver configured to supply first to fifth scan signals respectively to the first to fifth scan lines;

an emission driver configured to supply a first emission control signal to the first emission control line; and a data driver configured to supply a data signal to the data line, wherein the pixel comprises:

a light emitting element;

a first transistor connected between a first node and a second node, the first transistor generating a driving current flowing from a first power line receiving a first power voltage to a second power line receiving a second power voltage through the light emitting element;

a second transistor connected between the data line and a fourth node, the second transistor being turned on in response to the fourth scan signal;

a third transistor connected between the second node and a third node connected to a gate electrode of the first transistor, the third transistor being turned on in response to the second scan signal;

a fourth transistor connected between the third node and a third power line through which a third power voltage is provided, the fourth transistor being turned on in response to the first scan signal;

a fifth transistor connected between the first node and the fourth node, the fifth transistor being turned on in response to the third scan signal;

a sixth transistor connected between the first node and the first power line, the sixth transistor being turned off in response to the first emission control signal;

a ninth transistor connected between the first node and a fifth power line through which a fifth power voltage is supplied, the ninth transistor being turned on in response to the fifth scan signal;

a first capacitor connected between the first power line and the fourth node; and a second capacitor connected between the third node and the fourth node, and wherein the emission driver sets the scan signals so that a period in which the second transistor is turned on and a period in which the third transistor is turned on do not overlap with each other.

17. The display device of claim 16, wherein the pixel further comprises:

a seventh transistor connected between the second node and a first electrode of the light emitting element, the seventh transistor being turned off in response to the second emission control signal supplied to the second emission control line; and an eighth transistor connected between a fifth node connected to the first electrode of the light emitting element and a fourth power line through which a fourth power voltage is provided, the eighth transistor being turned on in response to the fifth scan signal.

18. The display device of claim 17, wherein the fourth scan signal is a signal shifted from the fifth scan signal.

19. The display device of claim 17, wherein a first non-emission period of one frame includes a first compensation period in which the first emission control signal is supplied to the sixth transistor and the second scan signal is supplied to the third transistor and a data writing period in which the first emission control signal is not supplied to the sixth transistor and the fourth scan signal is supplied to the second transistor, so that the data voltage supplied to the data line is written to the fourth node.

20. The display device of claim 19, wherein the first non-emission period of the one frame includes a second compensation period in which the third scan signal is not supplied to the fifth transistor and the fifth scan signal is supplied to the ninth transistor, so that a bias voltage is transferred to the first transistor through the fifth power line.

* * * * *